US010927727B2

(12) United States Patent
Furuishi et al.

(10) Patent No.: US 10,927,727 B2
(45) Date of Patent: Feb. 23, 2021

(54) OIL CIRCULATION SYSTEM OF INTERNAL COMBUSTION ENGINE

(71) Applicant: TOYOTA JIDOSHA KABUSHIKI KAISHA, Toyota (JP)

(72) Inventors: Akio Furuishi, Shizuoka-ken (JP); Yuichi Miyazaki, Susono (JP); Toshiaki Asada, Mishima (JP); Shintaro Horisawa, Anjo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 273 days.

(21) Appl. No.: 15/992,891

(22) Filed: May 30, 2018

(65) Prior Publication Data

US 2018/0347419 A1 Dec. 6, 2018

(30) Foreign Application Priority Data

May 31, 2017 (JP) ..... JP2017-108812

(51) Int. Cl.

| | |
|---|---|
| ***F01M 5/00*** | (2006.01) |
| ***F01M 11/00*** | (2006.01) |
| ***F01M 1/02*** | (2006.01) |
| ***F01M 1/12*** | (2006.01) |
| ***F01M 1/16*** | (2006.01) |

(52) U.S. Cl.

CPC ..... *F01M 11/0004* (2013.01); *F01M 1/02* (2013.01); *F01M 1/12* (2013.01); *F01M 1/16* (2013.01); *F01M 5/002* (2013.01); *F01M 5/005* (2013.01); *F01M 5/001* (2013.01); *F01M 2001/123* (2013.01); *F01M 2005/004* (2013.01); *F01M 2011/0037* (2013.01); *F01M 2011/0045* (2013.01)

(58) Field of Classification Search

CPC ..... F01M 2005/023; F01M 2011/0037; F01M 2001/123; F16H 57/0452

USPC ..... 123/196

See application file for complete search history.

(56) References Cited

U.S. PATENT DOCUMENTS 5,220,892 A * 6/1993 Boemer ..... F01M 1/16 123/196 AB
5,301,642 A * 4/1994 Matsushiro ..... F01M 5/001 123/142.5 R (Continued)

FOREIGN PATENT DOCUMENTS

DE 3032090 A1 4/1982
JP S62-174517 A 7/1987

(Continued)

*Primary Examiner* — Long T Tran
*Assistant Examiner* — James J Kim
(74) *Attorney, Agent, or Firm* — Hunton Andrews Kurth LLP

(57) ABSTRACT

An oil circulation system of an internal combustion engine comprises a first oil pan and second oil pan, first oil supplied parts supplied with oil stored in the first oil pan, second oil supplied parts supplied with oil stored in the second oil pan, and a heating part. The heating part has oil paths through which oil flows and heats the oil flowing through the oil paths. The oil circulation system comprises a first circulation path circulating oil through the first oil pan, heating part, and first oil supplied parts, and a second circulation path circulating oil between the second oil pan and the second oil supplied parts.

11 Claims, 12 Drawing Sheets

(56) References Cited

U.S. PATENT DOCUMENTS

| | | | | |
|---|---|---|---|---|
| 2008/0066982 | A1* | 3/2008 | Kobayashi | F01M 11/0004 180/69.1 |
| 2008/0275600 | A1* | 11/2008 | Rask | B60L 58/12 701/22 |
| 2009/0145695 | A1* | 6/2009 | Hiramatsu | F01M 11/0004 184/106 |
| 2009/0277416 | A1* | 11/2009 | Saito | F01M 11/0004 123/196 AB |
| 2013/0042825 | A1* | 2/2013 | Shimasaki | F01M 5/001 123/2 |
| 2015/0075481 | A1* | 3/2015 | Cattani | F01N 5/02 123/196 AB |
| 2015/0218980 | A1* | 8/2015 | Bonde | F01M 11/0004 184/6.5 |
| 2016/0341081 | A1* | 11/2016 | Takama | F01M 1/12 |
| 2018/0251202 | A1* | 9/2018 | Saruwatari | F01P 7/16 |

FOREIGN PATENT DOCUMENTS

| | | | |
|---|---|---|---|
| JP | H04-111505 | U | 9/1992 |
| JP | H05001536 | A | 1/1993 |
| JP | H06014415 | U | 2/1994 |
| JP | H06054409 | A | 2/1994 |
| JP | 2000199416 | A | 7/2000 |
| JP | 2003148120 | A | 5/2003 |
| JP | 2006144688 | A | 6/2006 |
| JP | 2008128124 | A | 6/2008 |
| JP | 2012-137016 | A | 7/2012 |
| JP | 2013204481 | A | 10/2013 |
| JP | 5747500 | B2 | 7/2015 |

* cited by examiner

OIL CIRCULATION SYSTEM OF INTERNAL COMBUSTION ENGINE

CROSS-REFERENCE TO RELATED APPLICATION

The present application claims priority to Japanese Patent Application No. 2017-108812 filed on May 31, 2017, which is incorporated herein by reference in its entirety.

TECHNICAL FIELD

The present invention relates to an oil circulation system of an internal combustion engine.

BACKGROUND ART

Known in the past has been an oil circulation system of an internal combustion engine, comprising an oil pan; a plurality of oil supplied parts to which oil stored in the oil pan is supplied; and a circulation path circulating oil through these oil pan and oil supplied parts. The oil supplied parts includes, for example, crank journals and crank pins provided at a crankshaft, oil jets supplying oil to the pistons and cylinder inner walls, etc.

In such an oil circulation system, while the internal combustion engine is warming up, the temperature of the oil is low, and therefore the viscosity thereof is high. Therefore, the friction loss is large while the temperature of the oil is low. As a result, the fuel efficiency is deteriorated while the internal combustion engine is warming up. Therefore, to suppress deterioration of the fuel efficiency while the internal combustion engine is warming up, it has been proposed to utilize the heat of the exhaust gas to quickly raise the temperature of the oil.

In the oil circulation system described in PLT 1, a bypass oil path is provided near the exhaust ports of the cylinder head. The system is configured so that while the internal combustion engine is warming up, oil flows through this bypass oil path. According to PLT 1, it is considered that by flowing the oil through the bypass oil path formed near the exhaust ports while the internal combustion engine is warming up, the temperature of the oil can quickly rise by the heat of the exhaust gas.

CITATION LIST

Patent Literature

PLT 1: Japanese Patent Publication No. 2012-137016A

PLT 2: Japanese Patent Publication No. S62-174517A

PLT 3: Japanese Utility Model Publication No. H4-111505A

SUMMARY OF INVENTION

Technical Problem

However, in the oil circulation system described in PLT 1, the oil raised in temperature by passing through the bypass oil path near the exhaust ports while the internal combustion engine is warming up is then supplied to all of oil supplied parts which require the supply of oil, even while warming up. At the time of cold start of the internal combustion engine, the oil supplied parts are low in temperature, and therefore if supplying oil to all of these oil supplied parts, heat is robbed from the oil at these oil supplied parts. As a result, the oil is slow to rise in temperature. Therefore, in the oil circulation system described in PLT 1, improvement is necessary for suppressing deterioration of fuel efficiency while warming up of the engine.

The present invention was made in consideration of the above issue and has as its object to suppress deterioration of the fuel efficiency while the internal combustion engine is warming up.

Solution to Problem

The present invention was made so as to solve the above problem and has as its gist the following.

(1) An oil circulation system of an internal combustion engine, comprising:

a first oil pan and a second oil pan;

a first oil supplied part to which oil stored in the first oil pan is supplied, and a second oil supplied part to which oil stored in the second oil pan is supplied;

a heating part having an oil path through which oil flows and heating oil flowing through the oil path;

a first circulation path circulating oil through the first oil pan, the heating part, and the first oil supplied part; and a second circulation path circulating oil through the second oil pan and the second oil supplied part.

(2) The oil circulation system of an internal combustion engine according to above (1), wherein the first circulation path is configured so that oil circulates through the first oil pan, the heating part, and the first oil supplied part in series.

(3) The oil circulation system of an internal combustion engine according to above (2), wherein the first circulation path is configured so that oil circulates through the first oil pan, the heating part, and the first oil supplied part in that order.

(4) The oil circulation system of an internal combustion engine according to any one of above (1) to (3), wherein the first oil pan is formed so that the amount of oil which can be stored in the first oil pan is smaller than that of the second oil pan.

(5) The oil circulation system of an internal combustion engine according to any one of above (1) to (4), wherein the first oil pan is provided with a cover covering at least part of the first oil pan.

(6) The oil circulation system of an internal combustion engine according to any one of above (1) to (5), wherein the first circulation path comprises a first bypass path bypassing the heating part and a first flow rate adjusting valve adjusting a flow rate to the first bypass path and the heating part.

(7) The oil circulation system of an internal combustion engine according to above (6), further comprising a control device controlling the first flow rate adjusting valve, wherein the control device controls the first flow rate adjusting valve so that oil does not flow into the first bypass path when the temperature of the oil circulating through the first circulation path is less than a predetermined first reference temperature, and controls the first flow rate adjusting valve so that oil flows into the first bypass path when the temperature of the oil circulating through the first circulation path is equal to or greater than the first reference temperature.

(8) The oil circulation system of an internal combustion engine according to above (7), wherein the control device controls the first flow rate adjusting valve so that oil flows to the heating part regardless of the temperature of the oil circulating through the first circulation path, and controls the flow rate of the oil flowing to the heating part to be smaller when the temperature of the oil circulating through the first circulation path is equal to or greater than the first reference temperature, compared to when it is less than that first reference temperature.

(9) The oil circulation system of an internal combustion engine according to any one of above (1) to (8), further comprising a cooling device cooling oil flowing into the heating part, wherein the first circulation path is configured so that oil circulates to the cooling device as well and comprises a second bypass path bypassing the cooling device and a second flow rate adjusting valve adjusting the flow rate to the second bypass path.

(10) The oil circulation system of an internal combustion engine according to above (9), further comprising a control device controlling the second flow rate adjusting valve, wherein the control device controls the second flow rate adjusting valve so that oil does not flow to the cooling device when the temperature of the heating part is less than a predetermined second reference temperature, and controls the second flow rate adjusting valve so that oil flows to the cooling device when the temperature of the heating part is equal to or greater than the predetermined second reference temperature.

(11) The oil circulation system of an internal combustion engine according to above (6), further comprising a cooling device cooling oil flowing into the heating part, wherein the first circulation path is configured so that oil is circulated to the cooling device as well, and comprises a second bypass path bypassing the cooling device and a second flow rate adjusting valve adjusting the flow rate to the second bypass path;

the oil circulation system further comprises a control device controlling the first flow rate adjusting valve and the second flow rate adjusting valve;

if the temperature of the oil circulating through the first circulation path is less than a predetermined first reference temperature, the control device controls the first flow rate adjusting valve so that oil does not flow into the first bypass path and controls the second flow rate adjusting valve so that oil does not flow into the cooling device; and if the temperature of the oil circulating through the first circulation path is equal to or greater than the predetermined first reference temperature, the control device controls the first flow rate adjusting valve so that oil flows into the first bypass path and controls the second flow rate adjusting valve so that oil does not flow into the cooling device, when the temperature of the heating part is less than a predetermined second reference temperature, and controls the first flow rate adjusting valve so that oil does not flow into the first bypass path and controls the second flow rate adjusting valve so that oil flows into the cooling device, when the temperature of the heating part is equal to or greater than the predetermined second reference temperature.

(12) The oil circulation system of an internal combustion engine according to any one of above (1) to (11), wherein the heating part includes an oil path formed in the vicinity of the exhaust passage through which exhaust gas flows.

(13) The oil circulation system of an internal combustion engine according to any one of above (1) to (12), wherein the heating part includes an oil path formed around a cylinder bore.

(14) The oil circulation system of an internal combustion engine according to any one of above (1) to (13), wherein the internal combustion engine is mounted in a vehicle provided with a motor for driving the vehicle and a motor control device for controlling that motor, and the heating part includes an oil path formed around the motor and/or the motor control device.

(15) The oil circulation system of an internal combustion engine according to any one of above (1) to (14), wherein the first oil supplied part is at least one of a crank journal, crank pin, cam journal, journal of a balance shaft, and shaft connecting a compressor and turbine of an exhaust turbocharger.

Advantageous Effects of Invention

According to the present invention, deterioration of the fuel efficiency while the internal combustion engine is warming up is suppressed.

DESCRIPTION OF EMBODIMENTS

Below, referring to the figures, embodiments of the present invention will be explained in detail. Note that, in the following explanation, similar components are assigned the same reference notations.

First Embodiment

<<Configuration of Internal Combustion Engine>>

Figure 1:
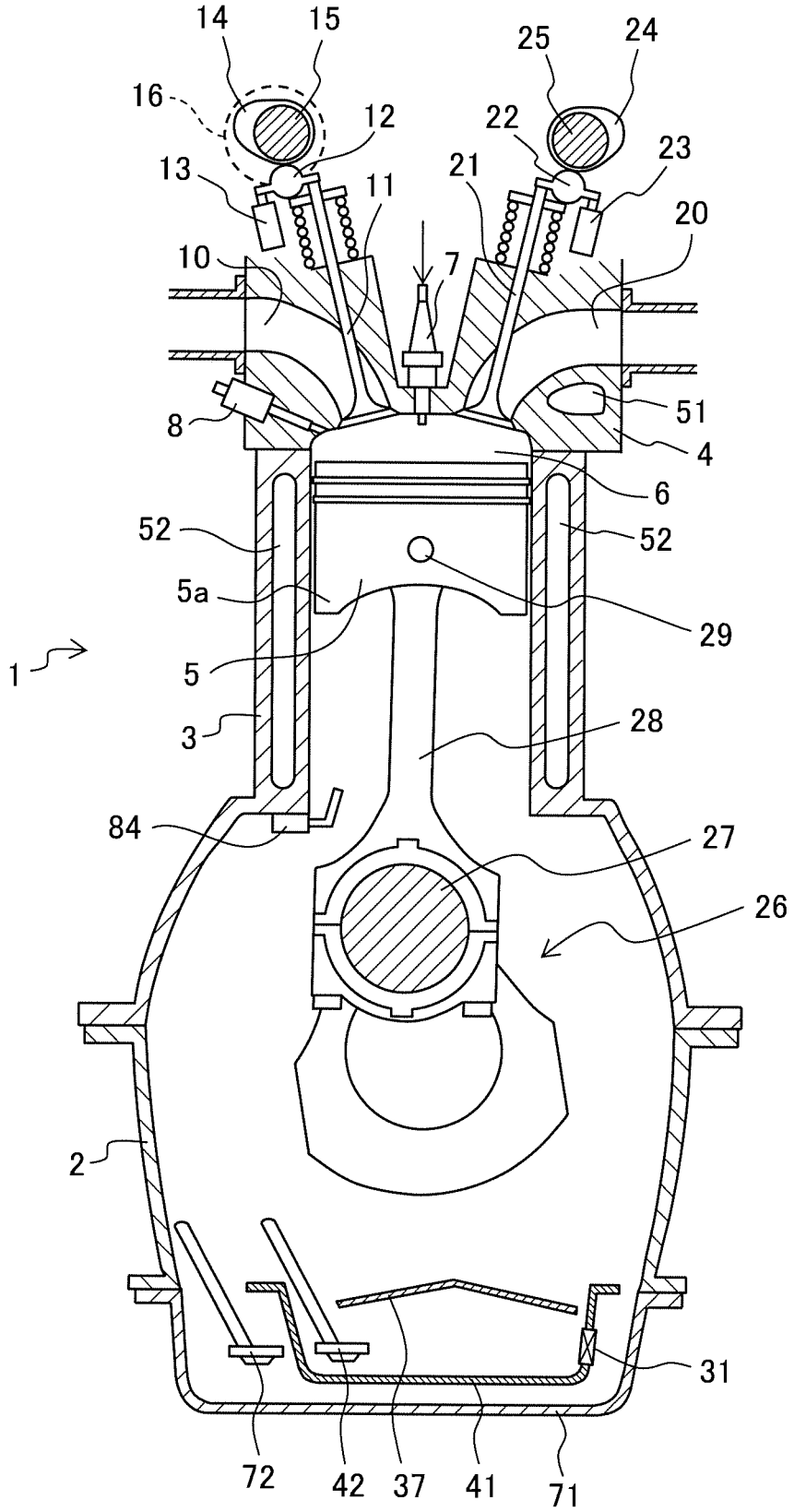
FIG. 1 is a schematic lateral cross-sectional view of an internal combustion engine provided with an oil circulation system.

FIG. 1 is a schematic lateral cross-sectional view of an internal combustion engine comprising the oil circulation system according to the first embodiment. As shown in FIG. 1, the internal combustion engine 1 comprises a crankcase 2, cylinder block 3, cylinder head 4, pistons 5, and combustion chambers 6. The cylinder block 3 is arranged on the crankcase 2. The cylinder head 4 is arranged on the cylinder block 3, while the pistons 5 reciprocate in cylinders formed in the cylinder block 3. The combustion chambers 6 are defined by the cylinder head 4, cylinders, and pistons 5.

The cylinder head 4 is provided with spark plugs 7 arranged at the center portions of the top surfaces of the combustion chambers 6 and igniting the air-fuel mixture in the combustion chambers 6, and fuel injectors 8 injecting fuel into the combustion chambers 6.

Further, the cylinder head 4 is formed with intake ports 10 through which intake gas flows, and is provides with intake valves 11 opening and closing intake ports 10. The upper end portions of the intake valves 11 are arranged so as to contact first end portions of intake rocker arms 12. The intake rocker arms 12 are arranged so that the other second end portions contact intake lash adjusters 13, and their center portions thereof contact the intake cams 14. The intake lash adjusters 13 bias the intake rocker arms 12 so that the valve clearances of the intake valves 11 is zero.

Intake cams 14 are fixed to an intake camshaft 15, and rotate along with rotation of the intake camshaft 15. The intake camshaft 15 is supported by bearings (not shown) formed at the cylinder head 4, and rotates in the bearings. In the present embodiment, the bearings supporting the intake camshaft are slide bearings, while the intake cam journals provided at the intake camshaft 15 rotate in the bearings.

If the intake camshaft 15 rotates, the intake cams 14 rotate. Due to this, the intake rocker arms 12 are pushed by the intake cams 14. By the intake rocker arms 12 being pushed by the intake cams 14 in this way, they swing downward about the end portions contacting the intake lash adjusters 13. Due to this, the intake valves 11 are opened.

Further, in the present embodiment, the end portion of the intake camshaft 15 is provided with an intake variable valve timing system (VVT system). This VVT system changes the relative angle between an intake cam pulley driven by a timing belt and the intake camshaft, by oil pressure, so as to change the valve timings of the intake valves 11. The VVT system is connected to an oil control valve (OCV). The oil pressure supplied to the VVT system is controlled by the OCV and thereby the valve timings of the intake valves 11 are controlled.

In addition, the cylinder head 4 is formed with exhaust ports 20 through which exhaust gas flows, and is provided with exhaust valves 21 opening and closing the exhaust ports 20. The upper end portions of the exhaust valves 21 are arranged so as to contact first end portions of the exhaust rocker arms 22. The exhaust rocker arms 22 are arranged so that the other second end portions contact the exhaust lash adjusters 23, and the center portions thereof contact exhaust cams 24. The exhaust lash adjusters 23 bias the exhaust rocker arms 22 so that the valve clearances of the intake valves 11 is zero.

Exhaust cams 24 are fixed to an exhaust camshaft 25, and rotate along with rotation of the exhaust camshaft 25. The exhaust camshaft 25 is supported by bearings (not shown) formed in the cylinder head 4, and rotates in the bearings. In the present embodiment, the bearings supporting the exhaust camshaft 25 are slide bearings. The exhaust cam journals provided at the exhaust camshaft 25 rotate in the bearings. Note that, an end portion of the exhaust camshaft may also be provided with an exhaust variable valve timing system.

The pistons 5 are connected through connecting rods 28 to a crankshaft 26. The connecting rods 28 are connected to piston pins 29 at first end portions and are connected to crank pins 27 of the crankshaft 26 at the other end portions. The connecting rods 28 connect the piston pins 29 and crank pins 27 so as to convert the reciprocating motion of the pistons 5 to rotational motion of the crankshaft 26.

The crankshaft 26 is supported by bearings (not shown) formed in the cylinder block 3, and rotate in the bearings. In the present embodiment, the bearings supporting the crankshaft 26 are slide bearings. The crank journals provided at the crankshaft 26 rotate in the bearings. Note that, in the present embodiment, the bearings for the crankshaft 26 are formed in the cylinder block 3, but may also be formed so that halves are provided at the cylinder block 3 and the crankcase 2 respectively.

<<Configuration of Oil Circulation System>>

Figure 2:
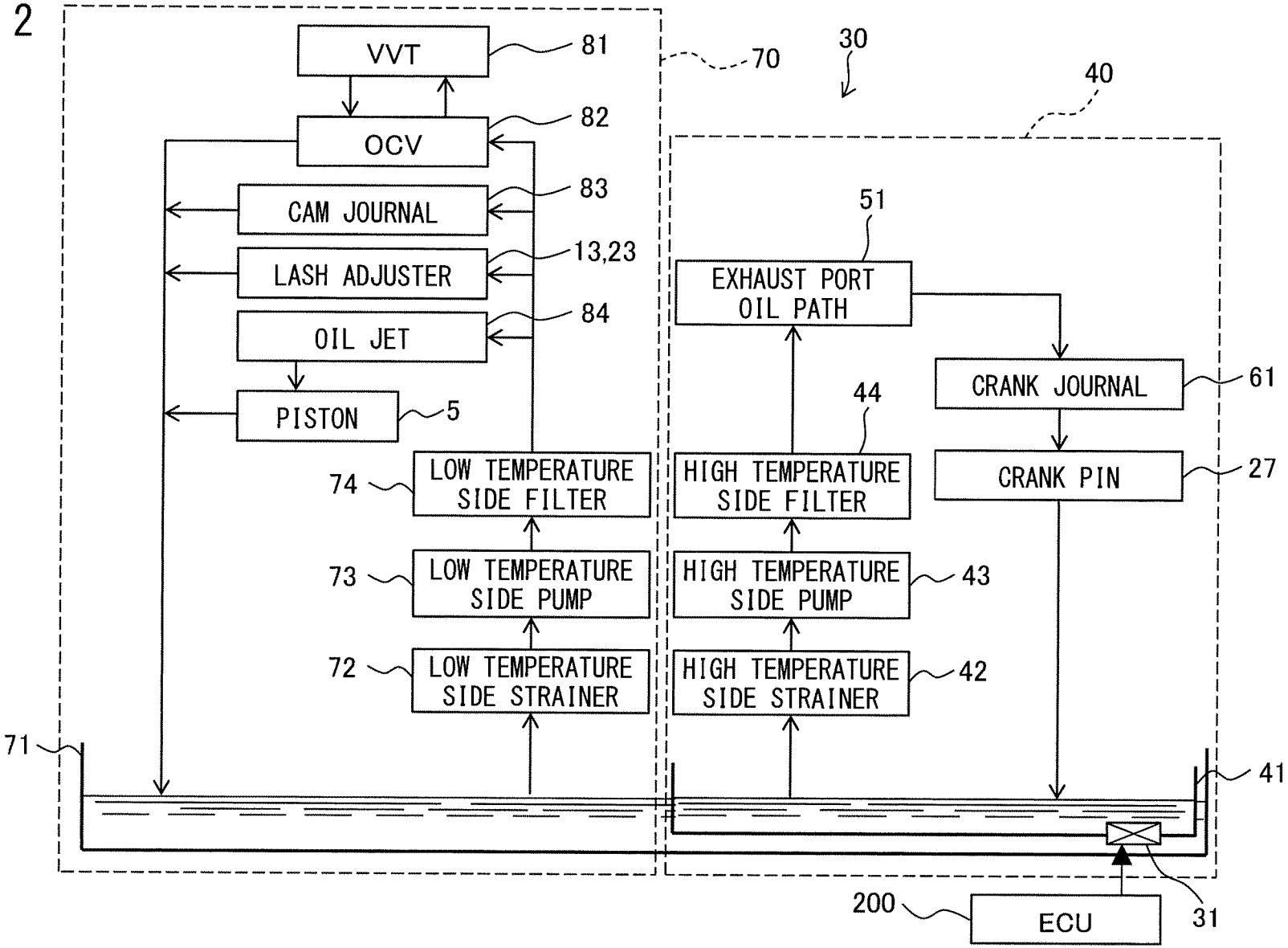
FIG. 2 is a view schematically showing the configuration of an oil circulation system.

Next, referring to FIGS. 1 and 2, the configuration of the oil circulation system 30 according to the first embodiment will be explained. FIG. 2 is a view schematically showing the configuration of the oil circulation system 30. The oil circulation system 30 of the present embodiment comprises two oil circulation paths configured so as to circulate oil independently from each other, that is, a high temperature side oil circulation path 40 and a low temperature side oil circulation path 70.

As shown in FIGS. 1 and 2, the oil circulation system 30 comprises two oil pans, that is, a high temperature side oil pan 41 and low temperature side oil pan 71. In the present embodiment, the high temperature side oil pan 41 is formed with a capacity smaller than the capacity of the low temperature side oil pan 71. Therefore, the amount of oil stored in the high temperature side oil pan 41 is smaller than the amount of oil stored in the low temperature side oil pan 71. Further, in the embodiment shown in FIGS. 1 and 2, the low temperature side oil pan 71 is directly attached to the crankcase 2 so as to cover the entire bottom opening of the crankcase 2. On the other hand, the high temperature side oil pan 41 is formed at the inside of the low temperature side oil pan 71. The high temperature side oil pan 41 is preferably arranged so as to be positioned below the crankshaft 26, in particular below the crank journals and crank pins 27. Further, the high temperature side oil pan 41 preferably is provided with a cover 37 covering at least part of the same, preferably substantially the entire part thereof. This cover 37 is formed by a heat insulating material. Due to this, the temperature of the oil stored in the high temperature side oil pan 41 can be kept from falling.

In the present embodiment, the high temperature side oil pan 41 formed at the inside is provided with an opening. This opening is arranged so as to connect the inside of the high temperature side oil pan 41 and the inside of the low temperature side oil pan 71. This opening is provided with a shutoff valve 31 for opening and closing this opening. Therefore, if this shutoff valve 31 is opened, the oil in the high temperature side oil pan 41 and the oil in the low temperature side oil pan 71 can be communicated with each other. On the other hand, when this shutoff valve 31 is closed, they cannot be communicated with each other. The shutoff valve 31 is connected to an electronic control unit (ECU) 200 and, is opened and closed by a command from the ECU 200. Note that, the shutoff valve 31 does not necessarily have to be connected to the ECU 200. For example, it may also be a valve which is automatically opened and closed in accordance with the temperature of the oil, such as a thermostat.

Note that, in the example shown in FIGS. 1 and 2, the high temperature side oil pan 41 is arranged inside the low temperature side oil pan 71. However, for example, if the high temperature side oil pan 41 and the low temperature side oil pan 71 are provided, it is also possible to provide partition walls in a single oil pan to separate it into the high temperature side oil pan 41 and the low temperature side oil pan 71, or configure them in another way.

The oil circulation system 30 comprises a high temperature side oil strainer 42, low temperature side oil strainer 72, high temperature side oil pump 43, low temperature side oil pump 73, high temperature side oil filter 44, and low temperature side oil filter 74.

The high temperature side oil strainer (below, referred to as the "high temperature side strainer") 42 is a mesh type filter device for removing foreign matter mixed into the oil stored in the high temperature side oil pan 41, and is arranged so as to be immersed in the oil stored in the high temperature side oil pan 41. The high temperature side strainer 42 is communicated with the high temperature side oil pump (below, referred to as the "high temperature side pump") 43. The oil stored in the high temperature side oil pan 41 is supplied through the high temperature side strainer 42 to the high temperature side pump 43.

The low temperature side oil strainer (below, referred to as the "low temperature side strainer") 72 is also a member similar to the high temperature side strainer 42, and is arranged so as to be immersed in the oil stored in the low temperature side oil pan 71. The low temperature side strainer 72 is communicated with the low temperature side oil pump (below, referred to as the "low temperature side pump") 73.

The high temperature side pump 43 is comprised of an electric powered type variable capacity oil pump. The high temperature side pump 43 pumps up the oil stored in the high temperature side oil pan 41 through the high temperature side strainer 42, and discharges the oil through the high temperature side oil filter (below, "high temperature side filter") 44 to the oil supplied parts. The low temperature side pump 73 is also comprised of an electric powered type variable capacity oil pump. The low temperature side pump 73 pumps up the oil stored in the low temperature side oil pan 71 through the low temperature side strainer 72, and discharges the oil through the low temperature side oil filter (below, "low temperature side filter") 74 to the oil supplied parts.

Note that, these pumps 43 and 73 may also be mechanical type oil pumps rotationally driven along with rotation of the crankshaft 26. In this case, relief valves are provided at outlets of the oil pumps for adjusting the discharge pressures. Further, in the present embodiment, the high temperature side pump 43 and the low temperature side pump 73 are configured as separate pumps, but they may also be configured as an integral single oil pump. In this case, for example, two pump systems with mutually independent oil paths are provided in a single oil pump. These two pump systems are driven by a single drive shaft.

The high temperature side filter 44 comprises a filter element for filtering the oil, and removes the foreign matter mixed in the oil discharged by the high temperature side pump 43. The oil flowing out from the high temperature side filter 44 is supplied through later explained oil paths 51 (heating part) formed in the vicinity of the exhaust ports 20 to the crank journals 61, etc. (high temperature side oil supplied parts). Similarly, the low temperature side filter 74 comprises a filter element for filtering the oil, and removes foreign matter mixed in the oil discharged from the low temperature side pump 73. The oil flowing out from the low temperature side filter 74 is supplied to the later explained OCV, etc. (low temperature side oil supplied parts).

Note that, in the present embodiment, the high temperature side filter 44 and the low temperature side filter 74 are configured as separate oil filters, but they may also be configured by an integral single oil filter. In this case, a single filter is provided with two oil paths independent from each other. Further, the filters 44 and 74 may be arranged anywhere so long as respectively inside the high temperature side oil circulation path 40 and the low temperature side oil circulation path 70. Therefore, for example, the high temperature side filter 44 may, for example, be arranged between the later explained exhaust port oil paths 51 and crank journals 61.

Furthermore, the oil circulation system 30 includes oil paths formed in the vicinity of the exhaust ports 20 formed in the cylinder block 3 (below, referred to as the "exhaust port oil paths") 51. The exhaust port oil paths 51 heat the oil flowing through the exhaust port oil paths 51 to raise the temperature of the oil.

The exhaust port oil paths 51 may be formed so as to extend in the vertical direction or may be formed so as to extend in the horizontal direction (for example, FIG. 1), in the vicinity of the exhaust ports 20. Further, they may be formed so as to include these two oil paths. Furthermore, when a single cylinder is formed so as to communicate with a plurality of exhaust ports 20, the oil paths may also be formed between the plurality of exhaust ports 20 communicated with the single cylinder. Since high temperature exhaust gas right after being discharged from the combustion chambers 6 flows in the exhaust ports 20, the oil flowing through the oil paths formed in the vicinity of the exhaust ports 20 robs the heat by heat exchange with the high temperature exhaust gas, and accordingly the temperature of the oil is raised. The oil heated in the exhaust port oil paths 51 circulates through the high temperature side oil circulation path 40, and is supplied to the crank journals 61. That is, the exhaust port oil paths 51 can be said to be configured so as to heat the oil supplied to the crank journals 61.

Note that, in the present embodiment, as the oil paths heating the oil flowing through the inside thereof, oil paths formed in the vicinities of the exhaust ports 20 are used. However, so long as oil paths formed in the vicinity of the exhaust passage through which the exhaust gas flows, oil paths formed other than in the vicinities of the exhaust ports 20 may also be used. The exhaust passage is formed by an exhaust manifold attached to the exhaust ports 20, a catalytic converter housing an exhaust purification catalyst, and an exhaust pipe, etc., and therefore, for example, an oil path formed in the vicinity of the exhaust manifold may also be used instead of the exhaust port oil paths 51.

In addition, the oil circulation system 30 comprises the oil supplied parts which are the targets of supply of oil. The oil supplied parts include components lubricated by supply of oil, components in which the supplied oil is used as a hydraulic fluid, and/or components which are cooled by supply of oil, etc.

In the example shown in FIG. 2, the oil circulation system 30 comprises the crank journals 61, crank pins 27, VVT system 81, cam journals 83, lash adjusters 13 and 23, and oil jets 84, as oil supplied parts.

The crank journals 61, as explained above, are supported in bearings formed in the cylinder block 3 and, rotate in the bearings. In the crank journals 61 as oil supplied parts, oil is supplied between the crank journals 61 and the bearings formed in the cylinder block 3. As explained above, the bearings are slide bearings, and therefore the crank journals 61 and bearings are lubricated due to hydrodynamic lubrication by the supplied oil. As a result, the frictional resistance is decreased.

The crank pins 27 are supported in the bearings formed at the lower end portions of the connecting rods 28, and turn in the bearings. In the crank pins 27 as oil supplied parts, oil is supplied between the crank pins 27 and the bearings formed at the connecting rods 28. These bearings are also slide bearings, and therefore the crank pins 27 and bearings are lubricated due to hydrodynamic lubrication by the supplied oil. As a result, the frictional resistance is decreased.

In the VVT system 81, oil is used as the hydraulic fluid. If oil is supplied to one hydraulic chamber of the VVT system 81, the intake camshaft 15 is turned so as to be advanced with respect to the intake cam pulley, and accordingly the intake valves 11 are advanced in valve timing. On the other hand, if oil is supplied to the other hydraulic chamber of the VVT system 81, the intake camshaft 15 is turned so as to be delayed with respect to the intake cam pulley, and accordingly the intake valves 11 are delayed in valve timing. The supply of oil to the hydraulic chambers of the VVT system 81 is controlled by the OCV 82. Therefore, the oil supplied to the oil supplied part of the OCV 82 is used for driving the VVT system 81.

The cam journals 83 include intake cam journals formed at the intake camshaft 15 and exhaust cam journals formed at the exhaust camshaft 25. The cam journals 83, as explained above, are supported in bearings formed at the cylinder head 4, and rotate in the bearings. In the cam journals 83 as oil supplied parts, oil is supplied between the cam journals 83 and the bearings formed at the cylinder head 4. These bearings are also slide bearings, and therefore the cam journals 83 and bearings are lubricated due to hydrodynamic lubrication by the supplied oil. As a result, the frictional resistance is decreased.

In the intake lash adjusters 13, oil is used as the hydraulic fluid. When valve clearance is formed between the intake rocker arms 12 and intake cams 14, the intake lash adjusters 13 are extended by the supplied oil. Similarly, in the exhaust lash adjusters 23, oil is used as the hydraulic fluid. When valve clearance is formed between the exhaust rocker arms 22 and exhaust cams 24, the exhaust lash adjusters 23 are extended by the supplied oil.

The oil jets 84 are attached to the cylinder block 3 below the cylinders. Oil is ejected toward the insides of the pistons 5 and the wall surfaces of the cylinders. The oil ejected toward the insides of the pistons 5 cool the pistons 5, and is supplied between the piston pins 29 and the bearings formed at the upper side end portions of the connecting rods 28. These bearings are also slide bearings, and therefore the piston pins 29 and bearings are lubricated due to hydrodynamic lubrication by the supplied oil. As a result, the frictional resistance is decreased.

Further, during reciprocating motion of the pistons 5, the pistons 5 swing in the cylinders about the piston pins 29. As a result, during reciprocating motion of the pistons 5, sometimes the piston skirts 5*a* of the pistons 5 and the cylinder wall surfaces slide in a state contacting each other. The oil jets 84 eject oil toward the wall surfaces of the cylinders, and therefore oil is supplied between the wall surfaces of the cylinders and the piston skirts 5*a*. Therefore, the piston skirts 5*a* of the pistons 5 and the wall surfaces of the cylinders are lubricated due to hydrodynamic lubrication by the supplied oil. As a result, the frictional resistance is decreased.

The high temperature side oil circulation path 40 is configured so that oil circulates through the high temperature side oil pan 41, high temperature side pump 43, high temperature side filter 44, exhaust port oil paths 51, crank journals 61, and crank pins 27. In particular, in the example shown in FIG. 2, the high temperature side oil circulation path 40 is configured so that oil stored in the high temperature side oil pan 41 circulates through the high temperature side pump 43, high temperature side filter 44, exhaust port oil paths 51, crank journals 61, and crank pins 27 in that order, and again returns to the high temperature side oil pan 41. Therefore, the oil circulated through the high temperature side oil circulation path 40 will not flow into the low temperature side oil circulation path 70 much at all, so long as the shutoff valve 31 is not opened.

The high temperature side oil circulation path 40 is basically configured as oil paths formed in the crankcase 2, cylinder block 3, and cylinder head 4. For example, the oil paths from the high temperature side filter 44 to the exhaust port oil paths 51 are formed in the cylinder block 3 and cylinder head 4, while the oil paths from the exhaust port oil paths 51 to the crank journals 61 are also formed in the cylinder block 3 and cylinder head 4.

On the other hand, oil circulates from the crank journals 61 and crank pins 27 to the high temperature side oil pan 41 due to oil dripping downward from between the crank journals 61 and crank pins 27 and their bearings. Therefore, in the high temperature side oil circulation path 40, there are always locations where oil is not circulated through the oil paths. However, whatever the case, the system is configured so that oil circulates among the above-mentioned components.

The low temperature side oil circulation path 70 is configured so that oil circulates through the low temperature side oil pan 71, low temperature side pump 73, low temperature side filter 74, OCV 82 of the VVT system 81, cam journals 83, lash adjusters 13, and oil jets 84. In particular, in the example shown in FIG. 2, the low temperature side oil circulation path 70 is configured so that oil stored in the low temperature side oil pan 71 circulates through the low temperature side pump 73 and the low temperature side filter 74 in that order, then is supplied separately to the OCV 82 of the VVT system 81, cam journals 83, lash adjusters 13, and oil jets 84, and again returns to the low temperature side oil pan 71. Therefore, the oil circulating through the low temperature side oil circulation path 70 will not flow much at all to the inside of the high temperature side oil circulation path 40 so long as the shutoff valve 31 is not opened.

The low temperature side oil circulation path 70 also basically is configured as oil paths formed in the crankcase 2, cylinder block 3, and cylinder head 4. For example, the oil paths from the low temperature side filter 74 to the cam journals 83 or lash adjusters 13 are formed in the cylinder block 3 and cylinder head 4, while the oil paths from the low temperature side filter 74 to the oil jets 84 are formed in the cylinder block 3.

The shutoff valve 31 is closed when the temperature of the oil stored in the high temperature side oil pan 41 or the temperature of the oil circulated through the high temperature side oil circulation path 40 is less than a predetermined temperature (normal operating temperature). Therefore, at this time, as explained above, oil is circulated independently in the high temperature side oil circulation path 40 and the low temperature side oil circulation path 70. On the other hand, the shutoff valve 31 is opened when the temperature of the oil stored in the high temperature side oil pan 41 becomes equal to or greater than a predetermined temperature. As a result, the oil in the high temperature side oil pan 41 and the oil inside the low temperature side oil pan 71 become able to move with respect to each other.

Alternatively, the shutoff valve 31 may be configured to be opened when the ignition switch is turned off and the internal combustion engine 1 stops, and to be closed while the internal combustion engine 1 is operating. As a result, it is possible to make the high temperature side oil circulation path 40 and the low temperature side oil circulation path 70 independent from each other while the internal combustion engine is operating, and possible to mix the oil of the two circulation paths to thereby make the degradation of the oil uniform while the internal combustion engine 1 is stopped.

<<Effects Due to Configuration of First Embodiment>>

The effects exhibited by the oil circulation system according to the first embodiment 30 explained with reference to FIGS. 1 and 2 will be explained. The high temperature side oil circulation path 40 is provided with exhaust port oil paths 51 heating the oil. Therefore, even when the temperature of the oil is low, for example, at the time of cold start of the internal combustion engine 1, it is possible to quickly raise the temperature of the oil circulating through the high temperature side oil circulation path 40. As a result, it is possible to suppress deterioration of the fuel efficiency accompanying the low temperature of oil.

In particular, in the present embodiment, the high temperature side oil circulation path 40 includes only part of the plurality of oil supplied parts (crank journals 61 and crank pins 27). At the time of cold start of the internal combustion engine, all of the oil supplied parts are low in temperature, and therefore if circulating oil through all of the oil supplied parts, it is harder for the oil to rise in temperature. Contrarily, in the present embodiment, the high temperature side oil circulation path 40 includes only part of the plurality of oil supplied parts, and therefore it is possible to make the oil circulating through the high temperature side oil circulation path 40 quickly rise in temperature. Further, in one example of the present embodiment, the high temperature side oil pan 41 is formed so that the capacity is smaller. Accordingly, the amount of oil stored in the high temperature side oil pan 41 is small. Therefore, due to this as well, in one example of the present embodiment, it is possible to make the oil circulating through the high temperature side oil circulation path 40 quickly rise in temperature.

In addition, in the present embodiment, the high temperature side oil circulation path 40 includes crank journals 61 and crank pins 27, as oil supplied parts to which oil is supplied. At the crank journals 61 and crank pins 27, combustion pressures in the combustion chambers 6 are continuously applied through the pistons 5, and hydrodynamic lubrication is performed by the oil. Therefore, at the crank journals 61 and crank pins 27, if the temperature of the oil is low, the rotation resistance is particularly great. In the present embodiment, even at the time of cold start of the internal combustion engine 1, since the temperature of the oil supplied to the crank journals 61 and crank pins 27 is made to quickly rise, it is possible to quickly reduce the rotation resistance of the crankshaft 26. As a result, it is possible to suppress deterioration of the fuel efficiency along with the low temperature of oil.

Further, in the present embodiment, the crank journals 61 are arranged at the immediate downstream from the exhaust port oil paths 51. Therefore, the high temperature oil flowing out from the exhaust port oil paths 51 passes through the oil paths formed in the cylinder block 3, etc., and is directly supplied to the crank journals 61. Therefore, even if the temperature of the oil stored in the high temperature side oil pan 41 is low, it is possible to raise the temperature of the oil supplied to the crank journals 61, and accordingly it is possible to suppress deterioration of the fuel efficiency along with a low temperature of oil.

<<Modifications>>

Figure 3:
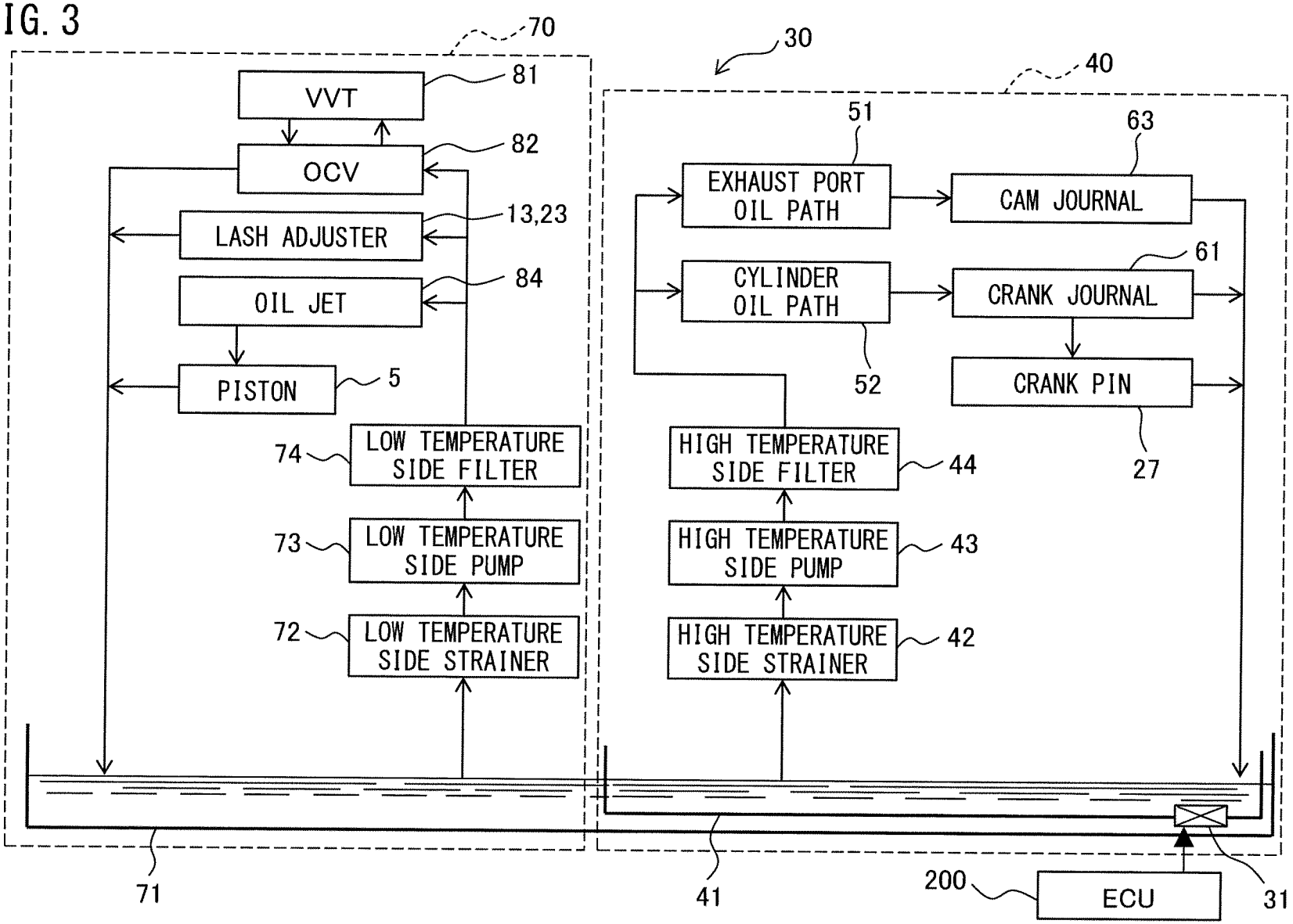
FIG. 3 is a view schematically showing the configuration of an oil circulation system according to a first modification of the first embodiment.

Next, referring to FIG. 3, a first modification of the oil circulation system according to the first embodiment will be explained. FIG. 3 is a view schematically showing the configuration of the oil circulation system according to the first modification.

As will be understood from FIG. 3, the oil circulation system 30 according to the first modification comprises oil paths 52 formed in the vicinities of the cylinder bores formed in the cylinder block 3 (below referred to as the "cylinder oil paths"), in addition to the exhaust port oil paths 51, for heating the oil in the high temperature side oil circulation path 40. The cylinder oil paths 52 heat the oil flowing through the cylinder oil paths 52 to make the oil rise in temperature. Therefore, the oil flowing out from the high temperature side filter 44 is supplied to the exhaust port oil paths 51 and the cylinder oil paths 52.

The cylinder oil paths 52, for example, are formed so as to partially extend in the circumferential directions of the cylinder bores, and, as shown in FIG. 1, to extend in the axial directions of the cylinders. If the air-fuel mixture burns in the combustion chambers 6, the temperature in the combustion chambers 6 becomes a high temperature. Along with this, the wall surfaces of the cylinders also become a high temperature. Therefore, by forming the oil paths 52 in the vicinities of the cylinders, the oil flowing through the oil paths 52 is heated by the high temperature cylinder walls, and therefore the oil is raised in temperature. The oil heated in the cylinder oil paths 52 circulates through the high temperature side oil circulation path 40, and is supplied to the crank journals 61. That is, in the present modification, the cylinder oil paths 52 can be said to be configured so as to heat the oil supplied to the crank journals 61.

Further, in the present modification, the high temperature side oil circulation path 40 is configured so that the oil heated by the exhaust port oil paths 51 is supplied to the cam journals 63. Therefore, in the present modification, unlike the first embodiment shown in FIG. 2, the cam journals 63 are arranged not in the low temperature side oil circulation path 70, but in the high temperature side oil circulation path 40.

In the first embodiment shown in FIG. 2, the cam journals 63 are supplied with low temperature oil while the internal combustion engine 1 is being warmed up. In the present modification, high temperature oil is supplied while the internal combustion engine 1 is being warmed up. As a result, in the present modification, while the internal combustion engine is being warmed up, the frictional resistance at the cam journals 63 can be reduced.

Note that, in the present modification, oil flowing out from the exhaust port oil paths 51 is supplied to the cam journals 63, while oil flowing out from the cylinder oil paths 52 is supplied to the crank journals 61, etc. However, so long as flows of oil raised in temperature at the exhaust port oil paths 51 and cylinder oil paths 52 are supplied to the cam journals 63 and crank journals 61, etc., the high temperature side oil circulation path 40 may be configured in any way. Therefore, for example, the oil flowing out from the exhaust port oil paths 51 may also be supplied to the crank journals 61, and the oil flowing out from the cylinder oil paths 52 may also be supplied to the cam journals 63.

Figure 4:
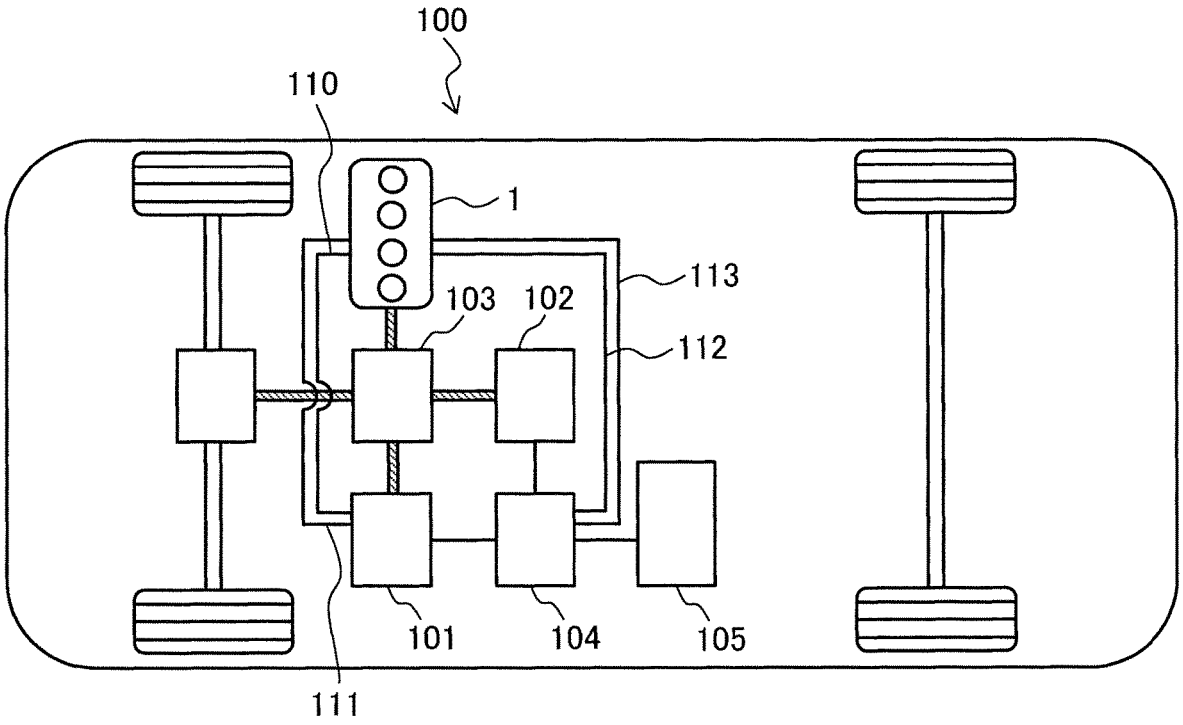
FIG. 4 is a view schematically showing a power train of a hybrid vehicle.

Next, referring to FIGS. 4 and 5, a second modification of the oil circulation system according to the first embodiment will be explained. In the second modification, the internal combustion engine 1 including the oil circulation system is mounted in a hybrid vehicle driven by the internal combustion engine 1 and a motor. FIG. 4 is a view schematically showing a power train of a hybrid vehicle 100, while FIG. 5 is a view schematically showing the configuration of an oil circulation system according to the second modification.

As shown in FIG. 4, the hybrid vehicle 100 comprises, in addition to the internal combustion engine 1, a motor 101, a generator 102, and a power split device 103. The motor 101 drives the vehicle together with the internal combustion engine 1, while the generator 102 generates electric power from the drive power of the internal combustion engine 1 or the kinetic energy of the hybrid vehicle 100. The power split device 103 is mechanically linked with the internal combustion engine 1, motor 101, and generator 102 by shafts and/or gears, and splits drive power among these. The power split device 103 is, for example, comprised of planetary gears.

Further, the hybrid vehicle 100 comprises a power control unit (PCU) 104 electrically connected to the motor 101 and generator 102, and a battery 105 connected to the PCU 104. The PCU (motor control device) 104 controls the motor 101 and generator 102, and comprises an inverter, DC-DC converter, etc., to convert the electric power supplied to the motor 101 and convert the electric power supplied from the generator 102.

Figure 5:
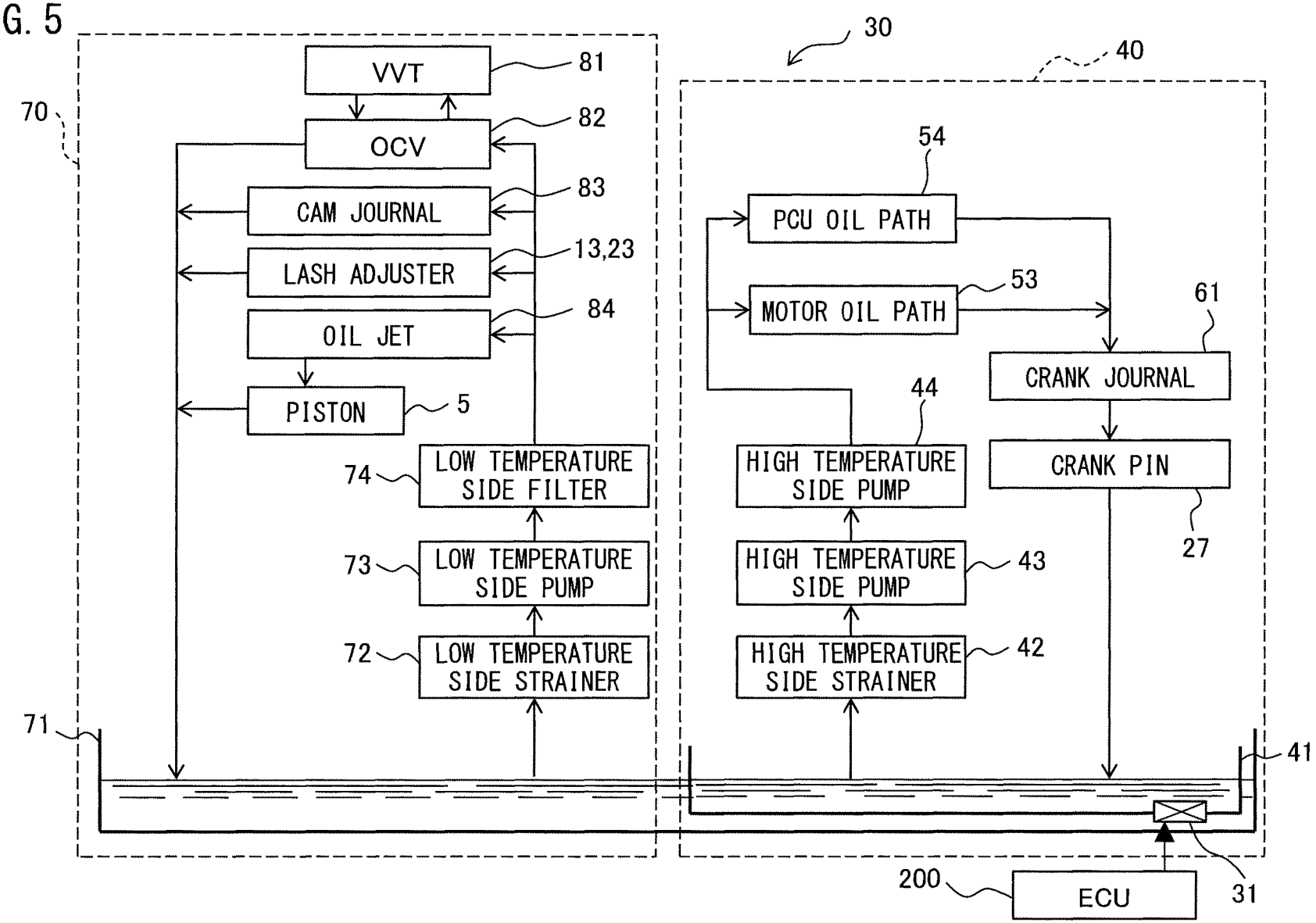
FIG. 5 is a view schematically showing the configuration of an oil circulation system according to a second modification of the first embodiment.

As shown in FIG. 5, in the present embodiment, the oil circulation system 30 comprises an oil path 53 formed in the vicinity of the motor 101 (below, referred to as the "motor oil path") and an oil path 54 formed in the vicinity of the PCU 104 (in particular, an inverter of the PCU 104 or other converter) (below, referred to as the "PCU oil path"). In this case, between the internal combustion engine 1 and the motor 101, a motor-use oil supply pipe 110 and motor-use oil return pipe 111 are provided. Between the internal combustion engine 1 and PCU 104, a PCU-use oil supply pipe 112 and PCU-use oil return pipe 113 are provided.

The oil discharged from the high temperature side pump 43 of the internal combustion engine 1 is supplied through the high temperature side filter 44 and the motor-use oil supply pipe 110 to the motor oil paths 53. Since the motor 101 becomes a high temperature along with its actuation, the oil flowing through the motor oil path is heated by heat exchange and, accordingly, the oil is raised in temperature rises. The oil raised in temperature is returned through the motor-use oil supply pipe 110 to internal combustion engine 1.

Further, the oil discharged from the high temperature side pump 43 of the internal combustion engine 1 is supplied through the high temperature side filter 44 and the PCU-use oil supply pipe 112 to the PCU oil path 54. Since the inverter of the PCU 104 or other converter becomes a high temperature along with actuation, the oil flowing through the PCU oil path 54 is heated by heat exchange and therefore the oil is raised in temperature. The oil raised in temperature is returned through the PCU-use oil pipe 113 to the internal combustion engine 1.

Note that, in the example shown in FIG. 5, the oil circulation system 30 comprises a motor oil path 53 and PCU oil path 54, but may also comprise just one of these. Further, in the example shown in FIG. 5, the motor oil path 53 and PCU oil path 54 respectively have both the oil supply pipe and oil return pipe connected to them, but each of the motor oil path 53 and PCU oil path 54 may be connected to only one of the oil supply pipe and oil return pipe, and the two oil paths may be connected by a connecting pipe. In this case, for example, oil flows from the internal combustion engine 1 through the oil supply pipe, motor oil path 53, connecting pipe between oil paths, PCU oil path 54, and oil return pipe, in this order, to the internal combustion engine 1.

Summary of First Embodiment

Figure 6:
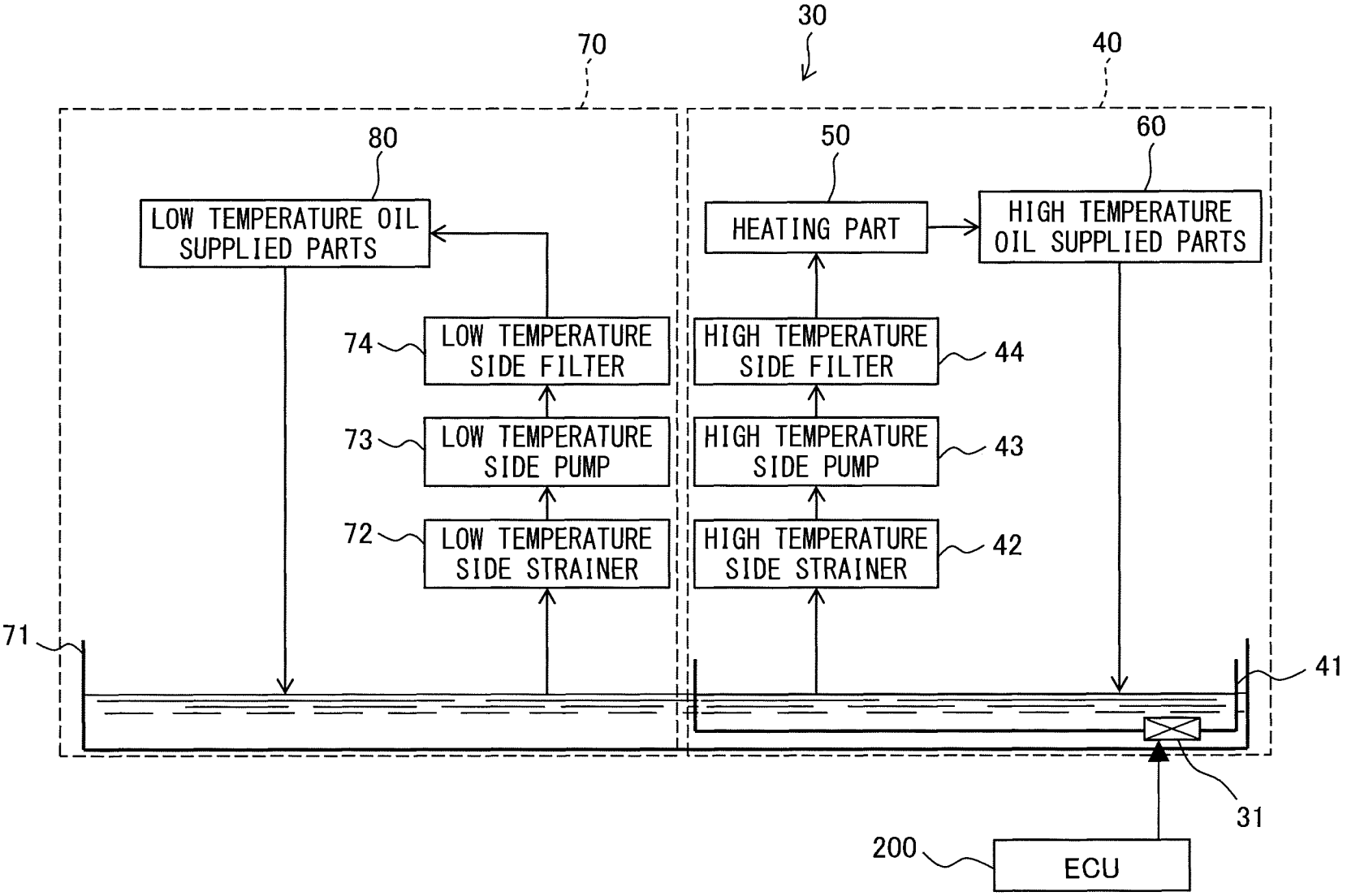
FIG. 6 is a view schematically showing the configuration of an oil circulation system according to the first embodiment and its modification.

If summarizing the first embodiment and its modification, the oil circulation system according to the first embodiment and its modification comprises, as shown in FIG. 6, a high temperature side oil pan 41 and low temperature side oil pan 71, high temperature side oil supplied parts 60 to which oil stored in the high temperature side oil pan 41 is supplied, low temperature side oil supplied parts 80 to which oil stored in the low temperature side oil pan 71 is supplied, and a heating part 50 having oil paths through which oil flows and heating oil flowing through the oil paths. In addition, the oil circulation system 30 comprises the high temperature side oil circulation path 40 for circulating oil through the high temperature side oil pan 41, heating part 50, and high temperature side oil supplied parts 60. Further, the oil circulation system 30 comprises the low temperature side oil circulation path 70 for circulating oil through the low temperature side oil pan 71 and low temperature side oil supplied parts 80.

The heating part 50 includes, for example, the above-mentioned exhaust port oil paths 51, cylinder oil paths 52, motor oil path 53, and/or PCU oil path 54. However, the heating part 50 may also be oil paths formed at other than the above-mentioned components so long as having oil paths through which oil flows and able to heat the oil flowing through the oil paths even while the internal combustion engine 1 is warming up. In particular, the heating part 50 preferably comprises oil paths formed in the components generating unnecessary (wasted) heat along with the internal combustion engine 1 or vehicle 100 being driven (that is, components cooled by cooling water). Further, the heating part 50 may be configured from only one oil path in the oil paths formed in the exhaust port oil paths 51, cylinder oil paths 52, motor oil path 53, PCU oil path 54, and other components, or may be configured from a plurality of the oil paths.

Further, the oil supplied parts to which oil is supplied include, as explained above, the crank journals 61, crank pins 27, VVT system 81, cam journals 83, lash adjusters 13 and 23, and/or oil jets 84, etc. In addition, when the internal combustion engine 1 has balance shafts, oil supplied parts may include the journals of the balance shafts. Further, when the internal combustion engine 1 has an exhaust turbocharger, an oil supplied part may include a shaft connecting a compressor and turbine of the exhaust turbocharger.

Among such a plurality of oil supplied parts, part of the oil supplied parts are arranged as high temperature side oil supplied parts 60 in the high temperature side oil circulation path 40. The high temperature side oil supplied parts 60 are supplied with oil heated by the heating part 50. On the other hand, the remaining oil supplied parts are arranged as low temperature side oil supplied parts 80 in the low temperature side oil circulation path 70. The low temperature side oil supplied parts 80 are supplied with oil not heated by the heating part 50.

The high temperature side oil supplied parts 60 include at least part of the components lubricated by fluid lubrication such as the slide bearings, etc. Components lubricated by hydrodynamic lubrication include the crank journals 61, crank pins 27, cam journals 63, journals of the balance shafts, shaft of the exhaust turbocharger, and/or piston skirts 5*a* (oil jets 84), etc. In components lubricated by hydrodynamic lubrication, if the temperature of the oil is low and thus the viscosity of the oil is low, the mechanical resistance is larger and accordingly the fuel efficiency is deteriorated. Therefore, according to the present embodiment, the temperature of the oil supplied to the components lubricated by hydrodynamic lubrication is raised even while the internal combustion engine is warming up, therefore the mechanical resistance is decreased, and accordingly deterioration of the fuel efficiency is suppressed.

Note that, the high temperature side oil supplied parts 60 do not have to include all of the components lubricated by hydrodynamic lubrication. Even if components lubricated by hydrodynamic lubrication, if the load applied to the components is not that large, a generated mechanical resistance is not that large even if the viscosity of the oil is low. Therefore, for example, the cam journals 63 and the piston skirts 5*a* may be arranged, as low temperature side oil supplied parts 80, in the low temperature side oil circulation path 70. On the other hand, since the load applied to the crank journals 61 is large, the crank journals 61 are preferably arranged, as high temperature side oil supplied parts 60, in the high temperature side oil circulation path 40.

On the other hand, the low temperature side oil supplied parts 80 include oil supplied parts not included in the high temperature side oil supplied parts 60. Therefore, for example, when the cam journals 63, piston skirts 5*a*, etc., are not included in the high temperature side oil supplied parts 60, that is, when they are not arranged in the high temperature side oil circulation path 40, these are included in the low temperature side oil supplied parts 80.

In addition, the low temperature side oil supplied parts 80 include components in which oil is used as a hydraulic fluid. Such components include, for example, the OCV 82 of the VVT system 81 and the lash adjusters 13, etc. These components are arranged in the low temperature side oil circulation path 70.

Further, in the oil circulation system according to the first embodiment and its modification, the high temperature side oil circulation path 40 is configured so that oil circulates through the high temperature side oil pan 41, heating part 50, and high temperature side oil supplied parts 60 in that order. As a result, as explained above, even if the temperature of the oil stored in the high temperature side oil pan 41 is low, it is possible to raise the temperature of the oil supplied to the high temperature side oil supplied parts 60, and therefore it is possible to suppress deterioration of the fuel efficiency accompanying the low temperature of oil.

However, in the high temperature side oil circulation path 40, the oil does not necessarily have to circulate in this order. The oil may also circulate through the high temperature side oil pan 41, high temperature side oil supplied parts 60, and heating part 50 in that order. Alternatively, the system may be configured so that oil circulates between the high temperature side oil pan 41 and high temperature side oil supplied parts 60 and oil circulates separately therefrom between the high temperature side oil pan 41 and heating part 50. Further, when the oil circulation system 30 comprises a plurality of heating parts 50 and a plurality of high temperature side oil supplied parts 60, it may also be configured so that in some of the heating parts, etc., oil flows through the high temperature side oil pan 41, heating part 50, and high temperature side oil supplied parts 60 in that order, while in the remaining heating parts, etc., oil flows in reverse.

Note that, the number of the high temperature side oil supplied parts 60 is preferably smaller than the number of the low temperature side oil supplied parts 80. In addition, the total surface area of the oil paths through which oil circulates in the high temperature side oil circulation path 40 is preferably smaller than the total surface area of the oil paths through which oil circulates in the low temperature side oil circulation path 70. As a result, it is possible to reduce the thermal capacity of the circulation route of the high temperature side oil circulation path 40 as a whole, and accordingly possible to more quickly raise the temperature of the oil at the time of cold start of the internal combustion engine 1.

Further, at least the high temperature side oil circulation path 40 of the oil circulation paths 40 and 70 may be covered by a heat insulating material. As a result, it is possible to keep down the dissipation of heat at the inside of the high temperature side oil circulation path 40, and accordingly more quickly raise the temperature of the oil at the time of cold start of the internal combustion engine 1.

Second Embodiment

Figure 7:
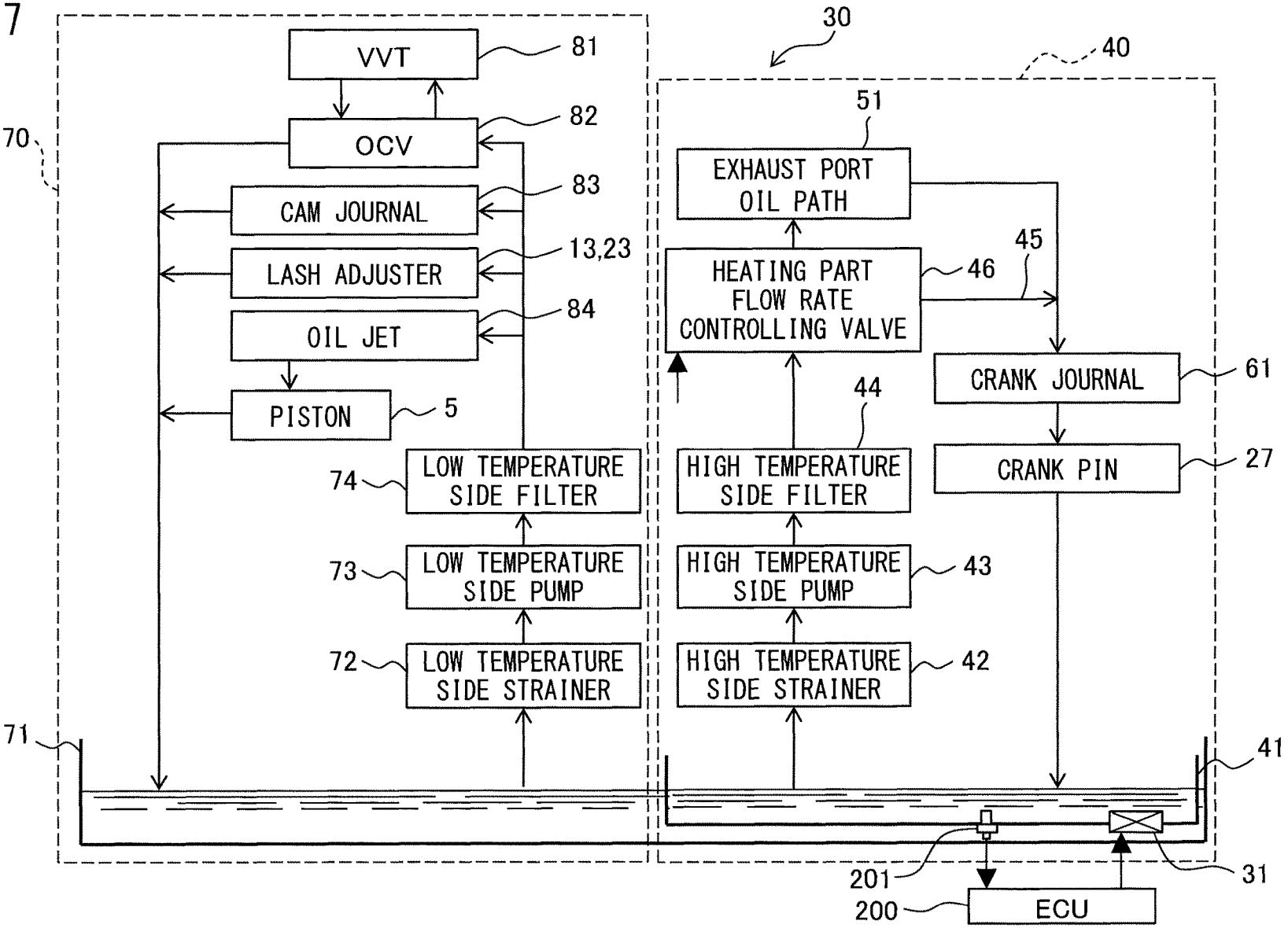
FIG. 7 is a view schematically showing the configuration of an oil circulation system according to a second embodiment.
Figure 8:
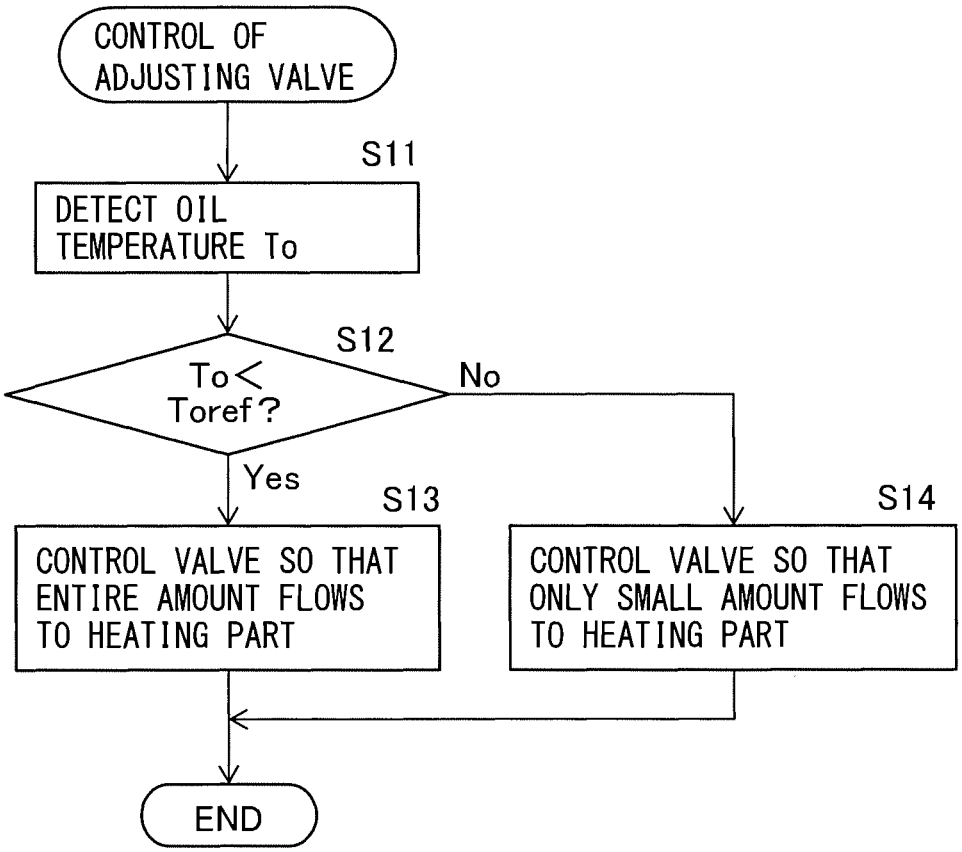
FIG. 8 is a flow chart showing a control routine for controlling a heating part flow rate adjusting valve.
Figure 9:
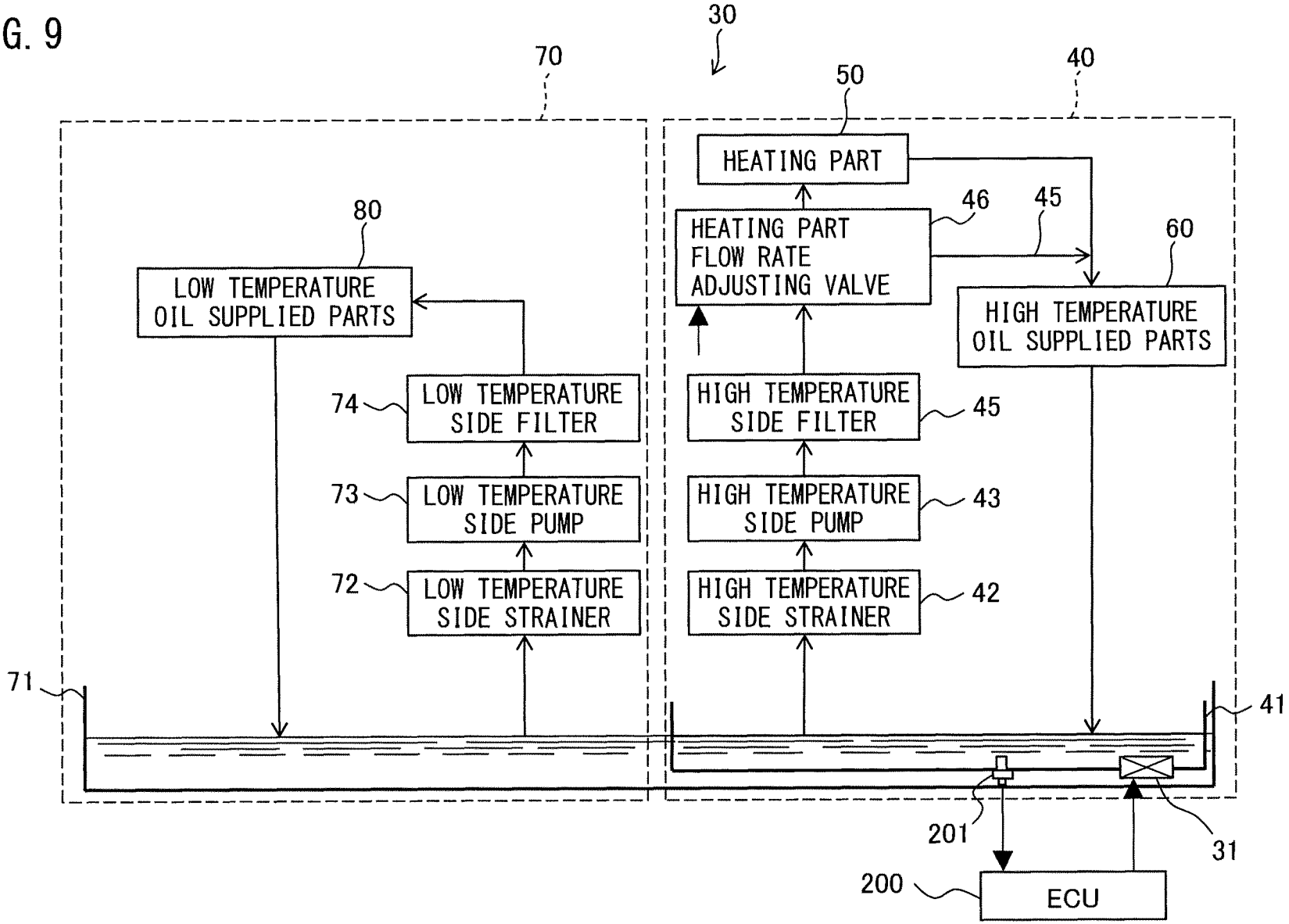
FIG. 9 is a view schematically showing the configuration of an oil circulation system according to the second embodiment.

Referring to FIGS. 7 to 9, an oil circulation system according to a second embodiment will be explained. The configuration of the oil circulation system according to the second embodiment is basically similar to the oil circulation system according to the first embodiment. Therefore, below, the parts different from the oil circulation system according to the first embodiment will be mainly explained.

FIG. 7 is a view schematically showing the configuration of the oil circulation system according to the second embodiment. As shown in FIG. 7, the oil circulation system 30 of the present embodiment comprises a heating part bypass path 45 bypassing the exhaust port oil paths 51, in addition to the oil circulation system of the first embodiment shown in FIG. 2. The heating part bypass path 45 is configured so as to connect the oil paths between the high temperature side filter 44 and the exhaust port oil paths 51, to the oil paths between the exhaust port oil paths 51 and crank journals 61. Therefore, oil flowing in from the high temperature side filter 44 to the heating part bypass path 45 flows into the crank journals 61 without flowing through the exhaust port oil paths 51.

In addition, the oil circulation system 30 of the present embodiment comprises a heating part flow rate adjusting valve 46 for adjusting the flow rate of oil flowing into the heating part bypass path 45 and the flow rate of oil flowing into the exhaust port oil paths 51. In particular, in the present embodiment, the heating part flow rate adjusting valve 46 is arranged at the branching portion where the heating part bypass path 45 branches from the oil path between the high temperature side filter 44 and the exhaust port oil paths 51. Therefore, the heating part flow rate adjusting valve 46 can make the entire amount of the oil flowing out from the high temperature side filter 44 flow into the exhaust port oil paths 51, and can make the entire amount flow into the heating part bypass path 45. The heating part flow rate adjusting valve 46 is connected to an electronic control unit (ECU) 200, and is controlled by a command from the ECU 200.

Furthermore, the oil circulation system 30 of the present embodiment comprises a temperature sensor 201 detecting the temperature of the oil stored in the high temperature side oil pan 41. The temperature sensor 201 is attached to the oil pan 41. Further, the temperature sensor 201 is connected to the CPU 200. The temperature of the oil detected by the temperature sensor 201 is input to the CPU 200.

Note that, in the present embodiment, the temperature of the oil circulating through the high temperature side oil circulation path 40 is detected by the temperature sensor 201 attached to the high temperature side oil pan 41. However, the temperature sensor 201 does not necessarily have to be attached to the high temperature side oil pan 41. So long as possible to detect the temperature of the oil circulating through the high temperature side oil circulation path 40, it may also be attached to another location such as the oil paths in the high temperature side oil circulation path 40. Therefore, for example, the temperature of the oil flowing into the exhaust port oil paths 51 or the temperature of the oil flowing out from the exhaust port oil paths 51 and flowing into the crank journals 61 may also be detected.

In this regard, if even after the internal combustion engine 1 finishes warming up and the oil in the high temperature side oil circulation path 40 is raised to a suitable temperature, oil continues to be circulated to the exhaust port oil paths 51, the oil circulating in the high temperature side oil circulation path 40 is excessively raised in temperature. If oil is excessively raised in temperature in this way, the oil circulated in the high temperature side oil circulation path 40 thermally degrades overall.

Therefore, in the present embodiment, when the temperature of the oil detected by the temperature sensor 201 is less than a first reference temperature, the heating part flow rate adjusting valve 46 is controlled so that oil does not flow into the heating part bypass path 45, therefore, so that the entire amount of oil flows into the exhaust port oil paths 51. In addition, when the temperature of the oil detected by the temperature sensor 201 is equal to or greater than the first reference temperature, the heating part flow rate adjusting valve 46 is controlled so that oil flows into the heating part bypass path 45, therefore, so that the flow rate of oil flowing into the exhaust port oil paths 51 decreases.

In particular, in the present embodiment, when the temperature of the oil detected by the temperature sensor 201 is equal to or greater than the first reference temperature, the heating part flow rate adjusting valve 46 is controlled so that only a very small amount of oil flows into the exhaust port oil paths 51. That is, in the present embodiment, the heating part flow rate adjusting valve 46 is controlled so that oil flows into the exhaust port oil paths 51 regardless of the temperature of the oil detected by the temperature sensor 201. Further, it is controlled so that when the temperature of the oil detected by the temperature sensor 201 is equal to or greater than the predetermined first reference temperature, the flow rate of oil flowing through the exhaust port oil paths 51 becomes smaller compared with when it is less than the first reference temperature.

In this regard, the first reference temperature is the temperature in a range of the suitable temperature of the oil in operating the internal combustion engine 1. Therefore, for example, it is a temperature which in general the oil as a whole will reach when the internal combustion engine 1 finishes warming up, for example, is 100° C.

According to the present embodiment, in this way, the heating part flow rate adjusting valve 46 is controlled so that after the oil of the high temperature side oil circulation path 40 reaches a suitable temperature, only a very small amount of oil is allowed to flow into the exhaust port oil paths 51. Therefore, oil of the suitable temperature is kept from flowing into the exhaust port oil paths 51 in a large amount and the oil is kept from being excessively raised in temperature.

Further, in the present embodiment, even after the oil of the high temperature side oil circulation path 40 becomes equal to or greater than the first reference temperature, oil flows through the exhaust port oil paths 51, although in a very small amount. In this regard, if oil no longer flows into the exhaust port oil paths 51 at all, the oil remaining in the exhaust port oil paths 51 is exposed to a high temperature over a long period of time. As a result, the oil remaining in the exhaust port oil paths 51 cokes and thus the oil is degraded. As opposed to this, in the present embodiment, oil flows through the exhaust port oil paths 51 in a very small amount, and accordingly the oil in the exhaust port oil paths 51 can be kept from coking.

FIG. 8 is a flow chart showing a control routine for controlling the heating part flow rate adjusting valve 46. The processing shown in the illustrated flow chart is executed by the ECU 200.

As shown in FIG. 8, first, at step S11, the temperature To of oil is detected by the temperature sensor 201. Next, at step S12, it is judged if the temperature To of oil is less than a first reference temperature Toref. If at step S12 it is judged that the temperature To of oil is less than the first reference temperature Toref, the routine proceeds to step S13. At step S13, the heating part flow rate adjusting valve 46 is controlled so that the entire amount of the oil flowing out from the high temperature side filter 44 flows into the exhaust port oil paths 51 (that is, heating part 50), that is, so that oil does not flow into the heating part bypass path 45, and then the control routine is ended. On the other hand, if at step S12 it is judged that the temperature To of oil is equal to or greater than the first reference temperature Toref, the routine proceeds to step S14. At step S14, the heating part flow rate adjusting valve 46 is controlled so that only a very small amount of the oil flowing out from the high temperature side filter 44 flows into the exhaust port oil paths 51 (that is, the heating part 50), that is, so that almost all of the oil flows into the heating part bypass path 45, and then the control routine is ended.

Note that, the example shown in the above-mentioned FIG. 7 shows the case in which the exhaust port oil paths 51 is used as the heating part 50 and the high temperature side oil supplied parts 60 are the crank journals 61 and crank pins 27. However, in the present embodiment as well, as explained referring to FIG. 6, it is possible to use the oil paths formed in various components as the heating part 50. Further, it is possible to make the high temperature side oil supplied parts 60 and low temperature side oil supplied parts 80 various oil supplied parts. Therefore, if considering these, the oil circulation system 30 of the present embodiment can be expressed as shown in FIG. 9.

That is, the oil circulation system 30 of the present embodiment comprises a heating part bypass path 45 for bypassing the heating part 50, and a heating part flow rate adjusting valve 46 for adjusting the flow rate of oil flowing into the heating part 50 and the flow rate of oil flowing into the heating part bypass path 45. The heating part flow rate adjusting valve 46 is controlled as explained above.

Note that, in the above embodiments, the temperature of the oil is detected by the temperature sensor 201 and the heating part flow rate adjusting valve 46 is controlled based on that temperature. However, it is not necessarily required to detect the temperature. It is also possible to estimate the temperature of the oil and control the heating part flow rate adjusting valve 46 based on the estimated temperature. In this case, for example, the heating part flow rate adjusting valve 46 is controlled based on the elapsed time from cold start of the internal combustion engine 1, the outside air temperature at the time of start of the internal combustion engine 1, etc.

Third Embodiment

Figure 10:
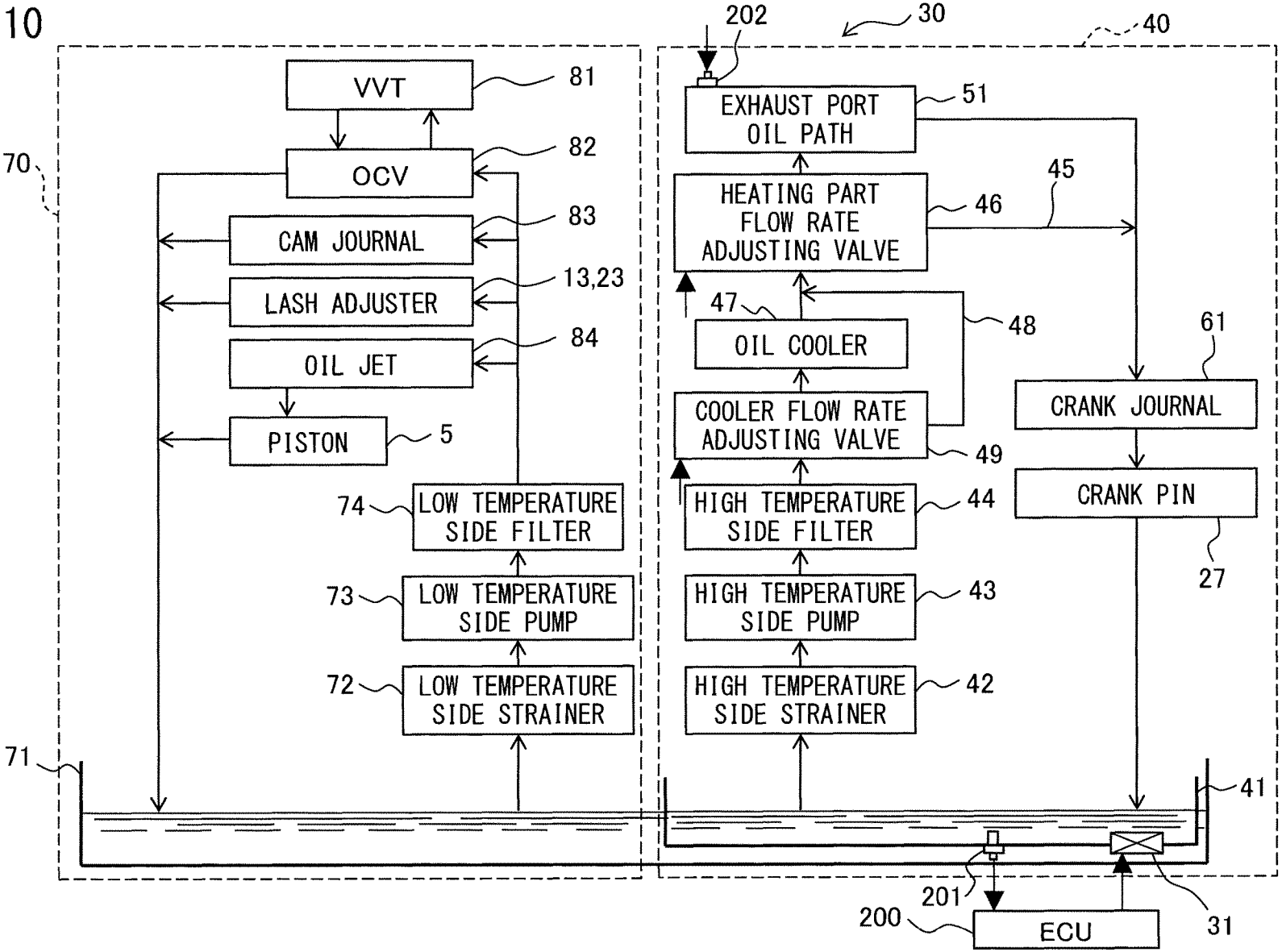
FIG. 10 is a view schematically showing the configuration of an oil circulation system according to a third embodiment.
Figure 11:
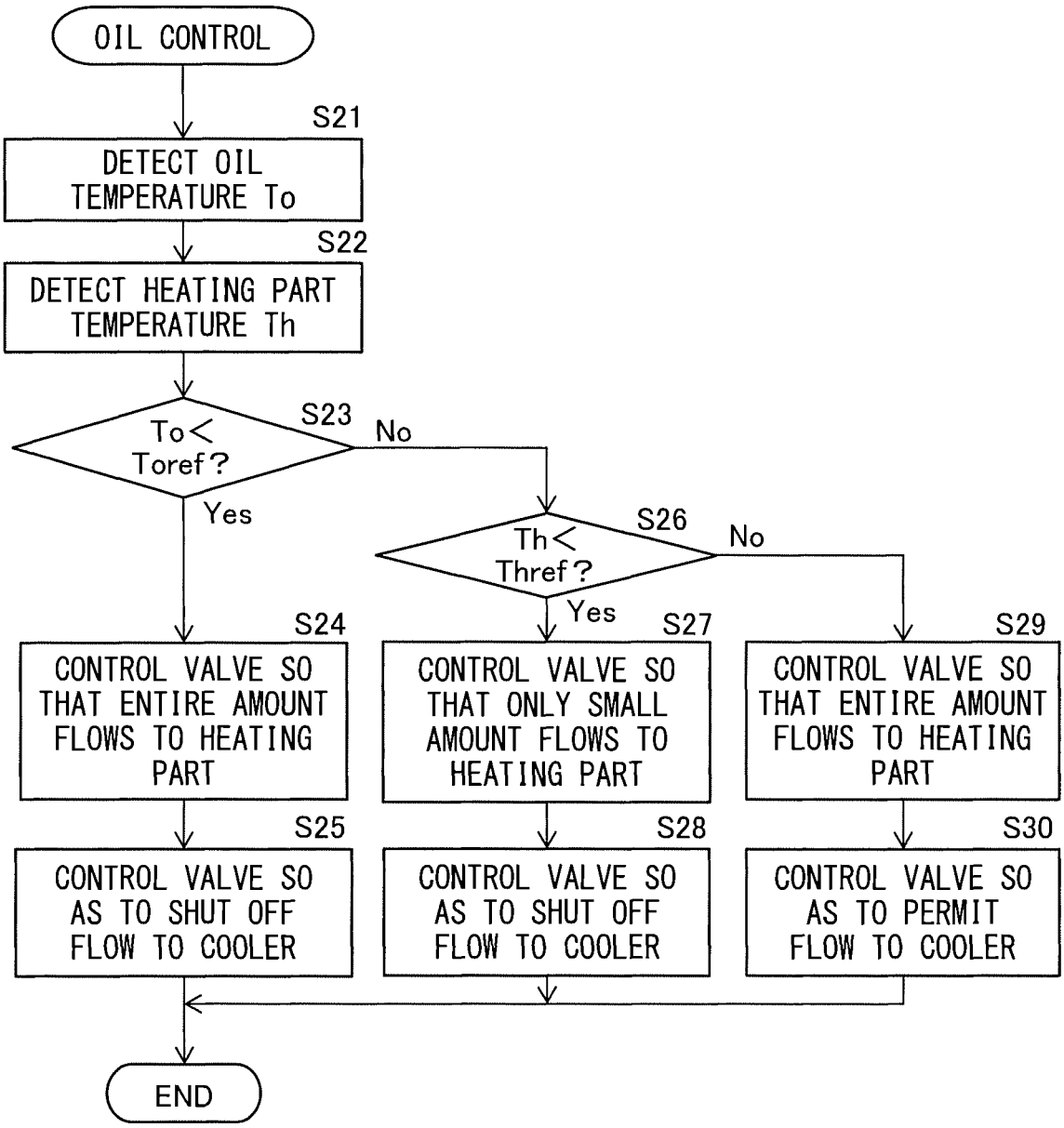
FIG. 11 is a flow chart showing a control routine for controlling a heating part flow rate adjusting valve and cooler flow rate adjusting valve.
Figure 12:
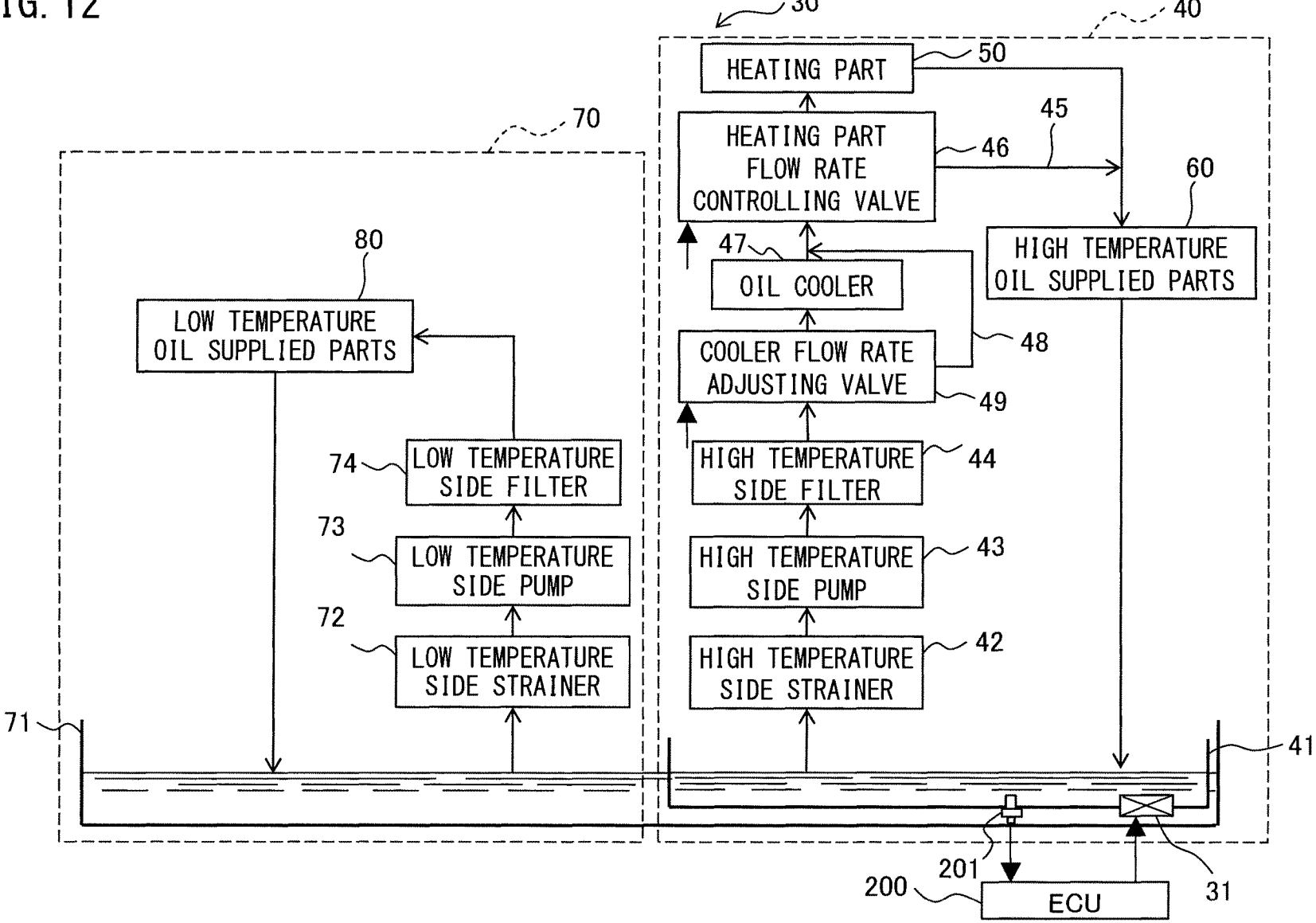
FIG. 12 is a view schematically showing the configuration of an oil circulation system according to the third embodiment.

Referring to FIGS. 10 to 12, an oil circulation system according to a third embodiment will be explained. The configuration of the oil circulation system according to the third embodiment basically is similar to the configuration of the oil circulation system according to the second embodiment. Therefore, below, the parts different from the oil circulation system according to the second embodiment will be mainly explained.

FIG. 10 is a view schematically showing the configuration of the oil circulation system according to the third embodiment. As shown in FIG. 10, the oil circulation system 30 of the present embodiment comprises an oil cooler (cooling device) 47, cooler bypass path 48, and cooler flow rate adjusting valve 49, in addition to the oil circulation system of the second embodiment shown in FIG. 7.

The oil cooler 47 is provided between the high temperature side filter 44 and the heating part flow rate adjusting valve 46. In other words, in the present embodiment, the oil cooler 47 is provided between the high temperature side oil pan 41 and the heating part 50, that is, at the immediate upstream side of the heating part 50. However, the oil cooler 47 does not necessarily have to be provided at this position. It may be provided anywhere so long as inside the high temperature side oil circulation path 40.

The oil cooler 47 is configured so as to cool the oil flowing through the inside thereof, therefore so as to cool the oil flowing into the exhaust port oil paths 51 (heating part 50). Specifically, the oil cooler 47 is, for example, configured from a plurality of flowing tubes with large numbers of fins provided at the outsides thereof, and cools the oil by the air in the vicinity of the oil cooler 47.

The cooler bypass path 48 is configured to connect the oil path between the high temperature side filter 44 and oil cooler 47 to the oil path between the oil cooler 47 and the heating part flow rate adjusting valve 46. Therefore, oil flowing from the high temperature side filter 44 into the cooler bypass path 48 flows into the exhaust port oil path 51 and/or crank journals 61 without flowing through the oil cooler 47.

The cooler flow rate adjusting valve 49 is configured so as to adjust the flow rate of oil flowing into the cooler bypass path 48 and the flow rate of oil flowing into the oil cooler 47. In particular, in the present embodiment, a cooler flow rate adjusting valve 49 is arranged at the branching portion where the cooler bypass path 48 branches off from the oil path between the high temperature side filter 44 and the oil cooler 47. Therefore, the cooler flow rate adjusting valve 49 enables the entire amount of oil flowing out from the high temperature side filter 44 to flow into the oil cooler 47, and also enables the entire amount of oil to flow into the cooler bypass path 48. The cooler flow rate adjusting valve 49 is connected to the ECU 200 and is controlled by a command from the ECU 200.

Furthermore, the oil circulation system 30 of the present embodiment includes a temperature sensor 202 detecting the temperature of the cylinder head 4 in the vicinity of the exhaust ports 20. The temperature sensor 202 is attached to the cylinder head 4. Further, the temperature sensor 202 is connected to a CPU 200. The temperature in the vicinity of the exhaust ports 20 detected by the temperature sensor 202 is input to the CPU 200.

In this regard, the oil flowing through the exhaust port oil paths 51 also functions as a cooling medium for lowering the temperature in the vicinities of the exhaust port oil paths 51. During warmup of the internal combustion engine 1, the temperature of the oil is low, and therefore it is possible to suitably lower the temperature in the vicinities of the exhaust port oil paths 51. On the other hand, after the end of warmup of the internal combustion engine 1, since the temperature of the oil is high, it is not necessarily possible to make the temperature in the vicinities of the exhaust port oil paths 51 sufficiently fall. Therefore, for example, if the load of the internal combustion engine 1 is temporarily extremely high and the temperature of the exhaust gas is high, the temperature of the cylinder head 4 in the vicinities of the exhaust ports 20 can no longer be maintained sufficiently low. In such a case, unnecessary heat is given to the air-fuel mixture in the combustion chambers 6 and, as a result, there is a possibility that knocking and other deterioration of combustion will be occurred.

Therefore, in the present embodiment, when the temperature in the vicinities of the exhaust ports 20 detected by the temperature sensor 202 is less than a second reference temperature, the cooler flow rate adjusting valve 49 is controlled so that oil does not flow into the oil cooler 47, therefore so that the entire amount of oil flows into the cooler bypass path 48. In addition, when the temperature in the vicinities of the exhaust ports 20 detected by the temperature sensor 202 is equal to or greater than the second reference temperature, the cooler flow rate adjusting valve 49 is controlled so that oil entirely or partially flows into the oil cooler 47 and therefore so that the flow rate of the oil flowing into the cooler bypass path 48 decreases or becomes zero. Further, at this time, the heating part flow rate adjusting valve 46 is controlled so that oil flows into the exhaust port oil paths 51, that is, so that oil does not flow into the heating part bypass path 45.

According to the present embodiment, when the temperature in the vicinities of the exhaust ports 20 is high, oil cooled by the oil cooler 47 is supplied to the exhaust port oil paths 51. Therefore, the temperature in the vicinities of the exhaust ports 20 can be maintained low and therefore the deterioration of combustion can be suppressed.

However, when the temperature of the oil circulating through the high temperature side oil circulation path 40 does not sufficiently rise, if the oil flows through the oil cooler 47, the temperature of the oil does not quickly rise any longer. Therefore, in the present embodiment, even if the temperature in the vicinities of the exhaust ports 20 detected by the temperature sensor 202 is equal to or greater than the second reference temperature, when the temperature of the oil detected by the temperature sensor 201 is less than the first reference temperature, the cooler flow rate adjusting valve 49 is controlled so that oil does not flow into the oil cooler 47.

Therefore, in the present embodiment, if the temperature of the oil detected by the temperature sensor 201 is less than the first reference temperature, the heating part flow rate adjusting valve 46 is controlled so that oil does not flow into the heating part bypass path 45, and the cooler flow rate adjusting valve 49 is controlled so that oil does not flow into the oil cooler 47. Further, if the temperature of the oil detected by the temperature sensor 201 is equal to or greater than the first reference temperature, when the temperature in the vicinity of the exhaust ports 20 detected by the temperature sensor 202 (that is, the temperature of the heating part 50) is less than the predetermined second reference temperature, the heating part flow rate adjusting valve 46 is controlled so that oil flows into the heating part bypass path 45, and the cooler flow rate adjusting valve 49 is controlled so that oil does not flow into the oil cooler 47. In addition, if the temperature of the oil detected by the temperature sensor 201 is equal to or greater than the first reference temperature, when the temperature in the vicinity of the exhaust ports 20 detected by the temperature sensor 202 is equal to or greater than the second reference temperature, the heating part flow rate adjusting valve 46 is controlled so that oil does not flow into the heating part bypass path 45, and the cooler flow rate adjusting valve 49 is controlled so that oil flows into the oil cooler 47.

FIG. 11 is a flow chart showing a control routine for controlling the heating part flow rate adjusting valve 46 and cooler flow rate adjusting valve 49. The processing shown in the illustrated flow chart is performed by the ECU 200.

As shown in FIG. 11, first, at step S21, the temperature To of oil is detected by the temperature sensor 201 detecting the temperature of the oil. Next, at step S22, the temperature in the vicinities of the exhaust ports 20 is detected by the temperature sensor 202 detecting the temperature in the vicinities of the exhaust ports 20. Next, at step S23, it is judged if the temperature To of oil detected by the step S21 is less than the first reference temperature Toref. If at step S23 it is judged that the temperature To of oil is less than the first reference temperature Toref, the routine proceeds to step S24. At step S24, the heating part flow rate adjusting valve 46 is controlled so that the entire amount of the inflowing oil flows into the exhaust port oil path 51 (that is, heating part 50), then at step S25, the cooler flow rate adjusting valve 49 is controlled so that the inflow oil does not flow into the oil cooler 47, and the control routine is ended.

On the other hand, if at step S23 it is judged that the temperature To of oil is equal to or great than the first reference temperature Toref, the routine proceeds to step S26. At step S26, it is judged if the temperature in the vicinities of the exhaust ports 20 detected at step S22 is less than the second reference temperature Thref. If at step S26 it is judged that the temperature in the vicinity of the exhaust ports 20 is less than the second reference temperature Thref, the routine proceeds to step S27. At step S27, the heating part flow rate adjusting valve 46 is controlled so that only a very small amount of the inflowing oil flows into the exhaust port oil paths 51 (that is, the heating part 50), then at step S28, the cooler flow rate adjusting valve 49 is controlled so that the inflowing oil does not flow into the oil cooler 47, and the control routine is ended.

If at step S26 it is judged that the temperature in the vicinities of the exhaust ports 20 is equal to or greater than the second reference temperature Thref, the routine proceeds to step S29. At step S29, the heating part flow rate adjusting valve 46 is controlled so that the entire amount of the inflowing oil flows into the exhaust port oil paths 51 (that is, heating part 50), then at step S30, the cooler flow rate adjusting valve 49 is controlled so that the entire amount of inflowing oil flows into the oil cooler 47, and the control routine is ended.

Note that, in the example shown in the above-mentioned FIG. 10, the case is shown where the exhaust port oil paths 51 are used as the heating part 50 and the high temperature side oil supplied parts 60 are the crank journals 61 and crank pins 27. However, in the present embodiment as well, as explained with reference to FIG. 6, it is possible to use oil paths formed in various components as the heating part 50. Further, it is possible to use various oil supplied parts as the high temperature side oil supplied parts 60 and low temperature side oil supplied parts 80. Therefore, if considering these, the oil circulation system 30 of the present embodiment can be expressed as shown in FIG. 12.

In particular, when using the oil paths formed in the vicinities of the cylinder bores as the heating part 50, if the temperature in the vicinities of the cylinder bores is too high, combustion is deteriorated. Further, when using the oil paths formed in the vicinities of the motor 101 and PCU 104 as the heating part 50, if the temperature of the motor 101 and PCU 104 is too high, there is a possibility of malfunctions occurring. According to the present embodiment, the temperature in the vicinities of the cylinder bore or the motor 101 or PCU 104 can be kept from excessively rising, and therefore deterioration of the combustion or impairment of functions can be suppressed.

Note that, in the above embodiments, the temperature sensor 202 is used to detect the temperature of the heating part 50, and the cooler flow rate adjusting valve 49 is controlled based on that temperature. However, it is not necessarily required to detect the temperature. It is also possible to estimate the temperature of the heating part 50 and control the cooler flow rate adjusting valve 49 based on the estimated temperature. In this case, for example, the cooler flow rate adjusting valve 49 is controlled based on the elapsed time from cold start of the internal combustion engine 1 and/or the outside air temperature at the time of start of the internal combustion engine 1, etc.

Further, in the above embodiments, the oil circulation system 30 includes the heating part bypass path 45 and heating part flow rate adjusting valve 46, but need not include the heating part bypass path 45 and heating part flow rate adjusting valve 46.

REFERENCE SIGNS LIST

1. internal combustion engine
2. crankcase
3. cylinder block
4. cylinder head
5. piston
6. combustion chamber
30. oil circulation system
40. high temperature side oil circulation path
41. high temperature side oil pan
50. heating part
60. high temperature oil supplied part
70. low temperature side oil circulation path
71. low temperature side oil pan
80. low temperature oil supplied part

The invention claimed is:

1. An oil circulation system of an internal combustion engine, comprising:

a first oil pan and a second oil pan;

a first oil supplied part to which oil stored in the first oil pan is supplied, and a second oil supplied part to which oil stored in the second oil pan is supplied;

a heating part having an oil path through which oil flows and heating oil flowing through the oil path;

a first circulation path circulating oil through the first oil pan, the heating part, and the first oil supplied part; and a second circulation path circulating oil through the second oil pan and the second oil supplied part; and a controller, wherein the first circulation path comprises a first bypass path bypassing the heating part and a first flow rate adjusting valve adjusting a flow rate to the first bypass path and the heating part, wherein the controller controls the first flow rate adjusting valve, wherein the controller is configured to control the first flow rate adjusting valve so that oil does not flow into the first bypass path when the temperature of the oil circulating through the first circulation path is less than a predetermined first reference temperature, and control the first flow rate adjusting valve so that oil flows into the first bypass path when the temperature of the oil circulating through the first circulation path is equal to or greater than the first reference temperature, and wherein the controller is configured to control the first flow rate adjusting valve so that oil flows to the heating part regardless of the temperature of the oil circulating through the first circulation path, and control the flow rate of the oil flowing to the heating part to be smaller when the temperature of the oil circulating through the first circulation path is equal to or greater than the first reference temperature, compared to when it is less than that first reference temperature.

2. The oil circulation system of an internal combustion engine according to claim 1, wherein the heating part includes an oil path formed in the vicinity of the exhaust passage through which exhaust gas flows.

3. The oil circulation system of an internal combustion engine according to claim 1, wherein the heating part includes an oil path formed around a cylinder bore.

4. The oil circulation system of an internal combustion engine according to claim 1, wherein the internal combustion engine is mounted in a vehicle provided with a motor for driving the vehicle and a motor controller for controlling that motor, and the heating part includes an oil path formed around the motor and/or the motor controller.

5. The oil circulation system of an internal combustion engine according to claim 1, wherein the first oil supplied part is at least one of a crank journal, crank pin, cam journal, journal of a balance shaft, and shaft connecting a compressor and turbine of an exhaust turbocharger.

6. The oil circulation system of an internal combustion engine according to claim 1, wherein the first circulation path is configured so that oil circulates through the first oil pan, the heating part, and the first oil supplied part in series.

7. The oil circulation system of an internal combustion engine according to claim 6, wherein the first circulation path is configured so that oil circulates through the first oil pan, the heating part, and the first oil supplied part in that order.

8. The oil circulation system of an internal combustion engine according to claim 1, wherein the first oil pan is formed so that the amount of oil which can be stored in the first oil pan is smaller than that of the second oil pan.

9. The oil circulation system of an internal combustion engine according to claim 1, wherein the first oil pan is provided with a cover covering at least part of the first oil pan.

10. An oil circulation system of an internal combustion engine, comprising:

a first oil pan and a second oil pan;

a first oil supplied part to which oil stored in the first oil pan is supplied, and a second oil supplied part to which oil stored in the second oil pan is supplied;

a heating part having an oil path through which oil flows and heating oil flowing through the oil path;

a first circulation path circulating oil through the first oil pan, the heating part, and the first oil supplied part;

a second circulation path circulating oil through the second oil pan and the second oil supplied part;

a cooling device cooling oil flowing into the heating part; and a controller, wherein the first circulation path is configured so that oil circulates to the cooling device as well and comprises a second bypass path bypassing the cooling device and a second flow rate adjusting valve adjusting the flow rate to the second bypass path, wherein the controller controls the second flow rate adjusting valve, and wherein the controller is configured to control the second flow rate adjusting valve so that oil does not flow to the cooling device when the temperature of the heating part is less than a predetermined second reference temperature, and control the second flow rate adjusting valve so that oil flows to the cooling device when the temperature of the heating part is equal to or greater than the predetermined second reference temperature.

11. An oil circulation system of an internal combustion engine, comprising:

a first oil pan and a second oil pan;

a first oil supplied part to which oil stored in the first oil pan is supplied, and a second oil supplied part to which oil stored in the second oil pan is supplied;

a heating part having an oil path through which oil flows and heating oil flowing through the oil path;

a first circulation path circulating oil through the first oil pan, the heating part, and the first oil supplied part;

a second circulation path circulating oil through the second oil pan and the second oil supplied part; and a cooling device cooling oil flowing into the heating part, wherein the first circulation path comprises a first bypass path bypassing the heating part and a first flow rate adjusting valve adjusting a flow rate to the first bypass path and the heating part, wherein the first circulation path is configured so that oil is circulated to the cooling device as well, and comprises a second bypass path bypassing the cooling device and a second flow rate adjusting valve adjusting the flow rate to the second bypass path;

wherein the oil circulation system further comprises a controller controlling the first flow rate adjusting valve and the second flow rate adjusting valve;

wherein if the temperature of the oil circulating through the first circulation path is less than a predetermined first reference temperature, the controller is configured to control the first flow rate adjusting valve so that oil does not flow into the first bypass path and controls the second flow rate adjusting valve so that oil does not flow into the cooling device; and wherein if the temperature of the oil circulating through the first circulation path is equal to or greater than the predetermined first reference temperature, the controller is configured to control the first flow rate adjusting valve so that oil flows into the first bypass path and controls the second flow rate adjusting valve so that oil does not flow into the cooling device, when the temperature of the heating part is less than a predetermined second reference temperature, and control the first flow rate adjusting valve so that oil does not flow into the first bypass path and controls the second flow rate adjusting valve so that oil flows into the cooling device, when the temperature of the heating part is equal to or greater than the predetermined second reference temperature.

* * * * *